US011854454B2

(12) United States Patent
Pyun et al.

(10) Patent No.: US 11,854,454 B2
(45) Date of Patent: Dec. 26, 2023

(54) DISPLAY DEVICE AND DRIVING METHOD THEREOF

(71) Applicant: Samsung Display Co., Ltd., Yongin-Si (KR)

(72) Inventors: Ki Hyun Pyun, Yongin-si (KR); Hee Sook Park, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 246 days.

(21) Appl. No.: 16/942,200

(22) Filed: Jul. 29, 2020

(65) Prior Publication Data

US 2021/0193016 A1 Jun. 24, 2021

(30) Foreign Application Priority Data

Dec. 18, 2019 (KR) ..... 10-2019-0169800

(51) Int. Cl.

| | |
|---|---|
| ***G09G 3/20*** | (2006.01) |
| *G09G 3/3233* | (2016.01) |
| *G09G 3/3275* | (2016.01) |

(52) U.S. Cl.

CPC ..... *G09G 3/2007* (2013.01); *G09G 3/3233* (2013.01); *G09G 3/3275* (2013.01); *G09G 2310/027* (2013.01); *G09G 2330/023* (2013.01); *G09G 2330/028* (2013.01)

(58) Field of Classification Search

CPC .. G09G 3/2007; G09G 3/3233; G09G 3/3275; G09G 2310/027; G09G 2330/023; G09G 2330/028; G09G 2320/0223; G09G 3/3225; G09G 3/2092; G09G 2320/0686; G09G 2330/021; G09G 2360/16; G09G 3/20; G09G 3/32; G09G 3/3208; G09G 3/3258; G09G 3/2085; G09G 2320/0271

See application file for complete search history.

(56) References Cited

U.S. PATENT DOCUMENTS

| | | | | |
|---|---|---|---|---|
| 8,957,837 | B2 | 2/2015 | Han | |
| 9,691,323 | B2 | 6/2017 | Lee et al. | |
| 10,297,184 | B2 | 5/2019 | Jeong et al. | |
| 10,748,317 | B2 * | 8/2020 | Park | G09G 3/3233 |
| 11,341,932 | B2 * | 5/2022 | Choi | G09G 3/20 |
| 11,361,709 | B2 * | 6/2022 | Pyun | G09G 3/32 |

(Continued)

FOREIGN PATENT DOCUMENTS

| | | | |
|---|---|---|---|
| KR | 10-2016-0119913 | A | 10/2016 |
| KR | 10-1883925 | B1 | 8/2018 |

*Primary Examiner* — Temesghen Ghebretinsae
*Assistant Examiner* — K. Kiyabu
(74) *Attorney, Agent, or Firm* — Innovation Counsel LLP

(57) ABSTRACT

A display device includes blocks each including two or more pixels commonly coupled to a first power line, and a first power voltage controller for determining a margin value of a first power voltage supplied to the first power line, based on load values of the blocks. The first power voltage controller determines the load values based on grayscale values of the pixels included in each of the blocks. The magnitude of the first power voltage is determined to become smaller as the margin value becomes larger. The margin value includes a first margin value. The first power voltage controller determines the first margin value according to a degree of distribution of load values of first blocks arranged in a first direction among the blocks.

15 Claims, 24 Drawing Sheets

(56) References Cited

U.S. PATENT DOCUMENTS

| | | | | |
|---|---|---|---|---|
| 11,361,731 | B2 * | 6/2022 | Choi | G09G 3/20 |
| 11,403,989 | B2 * | 8/2022 | Pyun | G09G 3/2092 |
| 11,657,767 | B2 * | 5/2023 | Pyun | G09G 3/3233 345/204 |
| 2009/0251399 | A1 * | 10/2009 | Kim | G09G 3/3406 382/169 |
| 2010/0177086 | A1 | 7/2010 | Nakamura et al. | |
| 2014/0240305 | A1 * | 8/2014 | Chae | G09G 3/3225 345/212 |
| 2014/0285535 | A1 | 9/2014 | Pyo | |
| 2015/0255019 | A1 * | 9/2015 | Park | G09G 3/3225 345/208 |
| 2016/0125807 | A1 * | 5/2016 | Wang | G09G 3/3275 345/205 |
| 2016/0180763 | A1 * | 6/2016 | Park | G09G 3/3258 345/691 |
| 2018/0068637 | A1 | 3/2018 | Ninan et al. | |

* cited by examiner

<PATTERN "A">

DISPLAY DEVICE AND DRIVING METHOD THEREOF

CROSS-REFERENCE TO RELATED APPLICATION

The present application claims priority under 35 U.S.C. § 119(a) to Korean patent application 10-2019-0169800 filed on Dec. 18, 2019 in the Korean Intellectual Property Office, the entire disclosure of which is incorporated herein by reference.

BACKGROUND

1. Technical Field

The present disclosure relates to a display device and a driving method of the same. More particularly, the present disclosure relates to a display device in which a minimum power voltage is supplied by analyzing a pattern of an image frame and the driving method of the same.

2. Related Art

With the development of information technologies, the importance of a display device which is a connection medium between a user and information increases. Accordingly, display devices such as a liquid crystal display device, an organic light emitting display device, and a plasma display device are increasingly used.

A display device may include a plurality of pixels, and display an image frame through a combination of lights emitted from the pixels. When a plurality of image frames are sequentially displayed, a user may recognize the image frames as an image (moving image or still image).

The magnitude of a required power voltage may vary depending on a pattern of an image frame. Therefore, if the same power voltage is supplied with respect to all image frames, it is inefficient in terms of power consumption. Therefore, a novel way to reduce power consumption and to improve display quality is needed

SUMMARY

Embodiments provide a display device in which a minimum power voltage is supplied by analyzing a pattern of an image frame, so that power consumption can be reduced, and a driving method of the display device.

In accordance with an aspect of the present disclosure, there is provided a display device including a plurality of blocks, each block including two or more pixels commonly coupled to a first power line, and a first power voltage controller configured to determine a margin value of a first power voltage supplied to the first power line based on load values of the blocks, wherein the first power voltage controller determines the load values based on grayscale values of the pixels included in each of the blocks, wherein the magnitude of the first power voltage is determined to become smaller as the margin value becomes larger, wherein the margin value includes a first margin value, and wherein the first power voltage controller determines the first margin value according to a degree of distribution of load values of first blocks arranged in a first direction among the blocks.

The display device may further include a plurality of first power sources, each of which is coupled to at least one of first power sub-lines. The first power sub-lines may be commonly coupled to the first power line. The first power sub-lines may be arranged in the first direction.

The first power voltage controller may determine the first margin value to become larger as the load values of the first blocks are distributed more widely in the first direction.

The first power voltage controller may determine the first margin value to become larger as the variation or standard deviation of the load values of the first blocks becomes smaller.

The first power voltage controller may include a plurality of distribution lookup tables. The first power voltage controller may select one of the distribution lookup tables according to the degree of distribution. The first power voltage controller may extract the first margin value from a selected distribution lookup table, based on an average value or maximum value of the load values of the first blocks.

The selected distribution lookup table may provide the first margin value to become smaller as the average value or maximum value of the load values of the first blocks becomes larger.

The margin value may further include a second margin value. The blocks may include second blocks arranged in a second direction perpendicular to the first direction. The first power voltage controller may determine the second margin value according to a position of one of the second blocks having a maximum value among load values of the second blocks.

The first power voltage controller may determine the second margin value to become larger as the position of the second block having the maximum value becomes closer to the first power sub-lines.

The first power voltage controller may include a plurality of position lookup tables. The first power voltage controller may select one of the position lookup tables according to the position of the second block having the maximum value. The first power voltage controller may extract the second margin value from a selected position lookup table based on an average value or maximum value of the load values of the second blocks.

The selected position lookup table may provide the second margin value to become smaller as the average value or maximum value of the load values of the second blocks becomes larger.

The margin value may further include a third margin value. The first power voltage controller may calculate grayscale value ratios of sections divided according to magnitudes of the grayscale values. The first power voltage controller may determine the third margin value according to a maximum section among sections having grayscale value ratios greater than a reference ratio.

The first power voltage controller may determine the third margin value to become smaller as the maximum section becomes larger.

The first power voltage controller may include a plurality of section lookup tables. The first power voltage controller may select a section lookup table corresponding to the maximum section among the section lookup tables. The first power voltage controller may extract the third margin value from the selected section lookup table, based on the grayscale value ratio of the maximum section.

The selected section lookup table may provide the third margin value to become smaller as the grayscale value ratio of the maximum section becomes larger.

The first power voltage controller may determine the margin value by adding up at least two of the first margin value, the second margin value, and the third margin value.

The first power voltage controller may determine the load values by adding up the grayscale values of the pixel included in each of the blocks.

In accordance with another aspect of the present disclosure, there is provided a method for driving a display device including a plurality of blocks, each block including two or more pixels commonly coupled to a first power line, the method including steps of determining load values of the blocks, based on grayscale values of the pixels, determining a margin value of a first power voltage supplied to the first power line based on the load values of the blocks, and determining the magnitude of the first power voltage to become smaller as the margin value becomes larger, wherein the margin value includes a first margin value, and wherein the determining of the margin value including determining the first margin value to become larger as load values of first blocks arranged in a first direction among the blocks are distributed more widely in the first direction.

The blocks may include second blocks arranged in a second direction perpendicular to the first direction. The display device may further include first power sub-lines for supplying the first power voltage to the first power line. The margin value may further include a second margin value. The determining of the margin value may further include determining the second margin value to become larger as a position of one of the second blocks having a maximum value among load values of the second blocks becomes closer to the first power sub-lines.

The margin value may further include a third margin value. The determining of the margin value may further include steps of calculating grayscale value ratios of sections divided according to magnitudes of the grayscale values, determining a maximum section among sections having grayscale value ratios greater than a reference ratio, and determining the third margin value to become smaller as the maximum section becomes larger.

The determining of the margin value may be accomplished by calculating the margin value by adding up at least two of the first margin value, the second margin value, and the third margin value.

In accordance with still another aspect of the present disclosure, there is provided a display device including a plurality of first pixels commonly coupled to a first power line, the first pixels being coupled to data lines of a first group, a plurality of second pixels commonly coupled to the first power line, the second pixels being coupled to data lines of a second group, a first driver unit coupled to the first power line through a first power sub-line, the first driver unit being coupled to the data lines of the first group, and a second driver unit coupled to the first power line through a second power sub-line, the second driver unit being coupled to the data lines of the second group, wherein a first voltage is supplied to the first power line in a first pattern in which X pixels among the first pixels and Y pixels among the second pixels emit light, and the other pixels among the first pixels and the other pixels among the second pixels do not emit light, wherein a second voltage is supplied to the first power line in a second pattern in which Z pixels among the first pixels emit light, and the other pixels among first pixels and all the second pixels do not emit light, wherein the second voltage is higher than the first voltage, and wherein the X, Y, and Z are any integers greater than 0, and $Z=X+Y$ is satisfied.

The X pixels, the Y pixels, and the Z pixels may all emit light, based on the same grayscale values.

A first luminance when the display device displays the first pattern and a second luminance when the display device displays the second pattern may be equal to each other.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
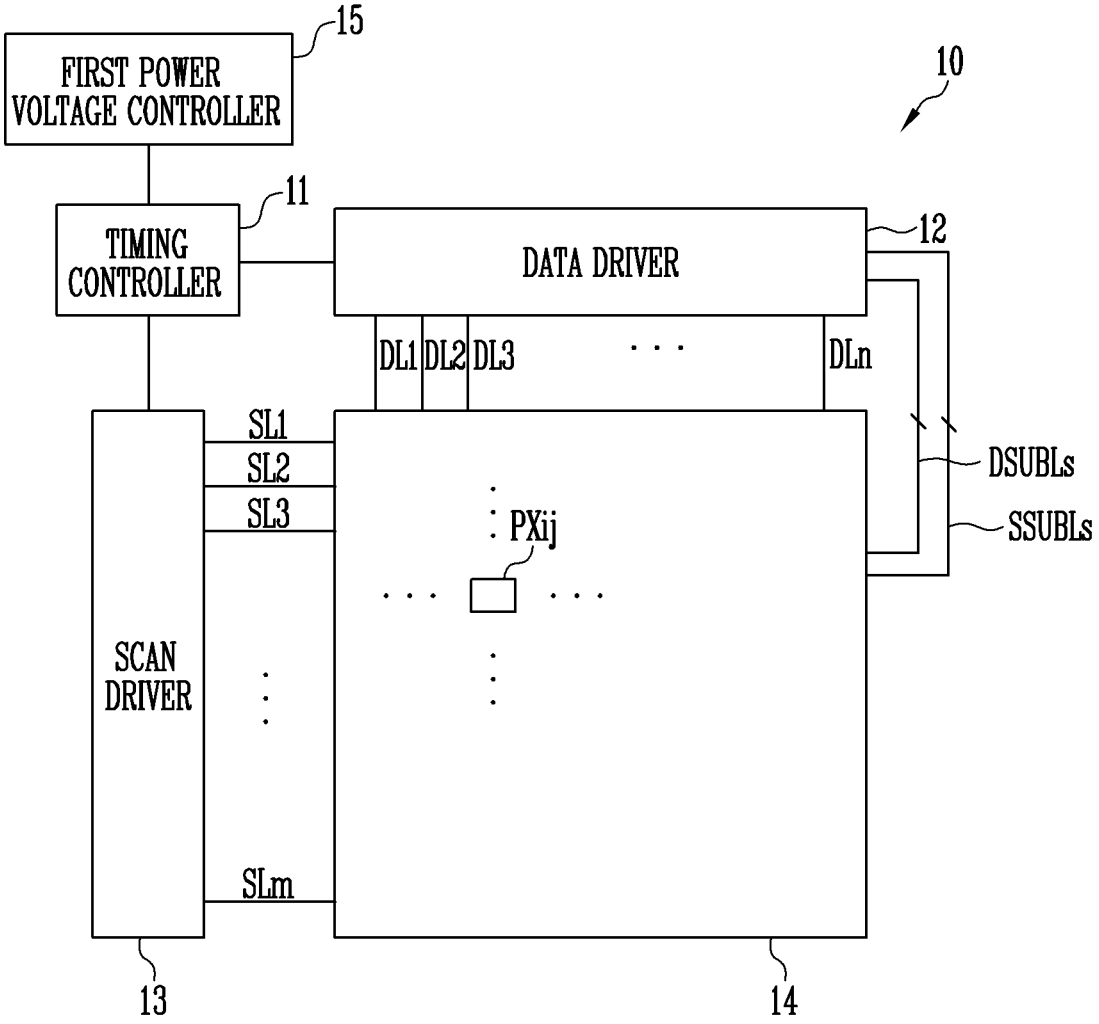
FIG. 1 is a diagram illustrating a display device in accordance with an embodiment of the present disclosure.

Hereinafter, example embodiments are described in detail with reference to the accompanying drawings so that those skilled in the art may easily practice the present disclosure. The present disclosure may be implemented in various different forms and is not limited to the example embodiments described in the present specification.

A part irrelevant to the description will be omitted to clearly describe the present disclosure, and the same or similar constituent elements will be designated by the same reference numerals throughout the present disclosure. Therefore, the same reference numerals may be used in different drawings to identify the same or similar elements.

In addition, the size and thickness of each component illustrated in the drawings are arbitrarily shown for better understanding and ease of description, but the present disclosure is not limited thereto. Thicknesses of several portions and regions are exaggerated for clear expressions.

FIG. 1 is a diagram illustrating a display device in accordance with an embodiment of the present disclosure.

Referring to FIG. 1, the display device 10 in accordance with the embodiment of the present disclosure may include a timing controller 11, a data driver 12, a scan driver 13, a pixel unit 14, and a first power voltage controller 15.

The timing controller 11 may receive grayscale values and control signals for each frame from an external processor (not shown). The timing controller 11 may render grayscale values to correspond to specifications of the display device 10. For example, the external processor may provide a red grayscale value, a green grayscale value, and a blue grayscale value with respect to each unit dot. However, when the pixel unit 14 has a pentile structure, adjacent unit dots share a pixel, and therefore, pixels may not correspond one-to-one to the respective grayscale values. Accordingly, it may be necessary to render the grayscale values. When pixels may correspond one-to-one to the respective grayscale values, it may be unnecessary to render the grayscale values. Grayscale values which are rendered or are not rendered may be provided to the data driver 12. Also, the timing controller 11 may provide the data driver 12, the scan driver 13, or the like with control signals suitable for the present disclosure of the data driver 12, the scan driver 13, or the like for the purpose of frame display.

The data driver 12 may generate data voltages to be provided to data lines DL1, DL2, DL3, . . . , and DLn by using grayscale values and control signals. For example, the data driver 12 may sample the grayscale values by using a clock signal, and apply data voltages corresponding to the grayscale values to the data lines DL1 to DLn in a unit of a pixel row. Here, n may be an integer greater than 0. The data driver 12 may be a group of a plurality of driver units. The display device 10 may include a plurality of data drivers as driver units are grouped. Arrangements of driver units will be described with reference to subsequent drawings.

The scan driver 13 may generate scan signals to be provided to scan lines SL1, SL2, SL3, . . . , and SLm by receiving a clock signal, a scan start signal, and the like from the timing controller 11. Here, m may be an integer greater than 0.

The scan driver 13 may sequentially supply scan signals having a pulse of a turn-on level to the scan lines SL1 to SLm. The scan driver 13 may include scan stages configured in the form of shift registers. The scan driver 13 may generate scan signals in a manner that sequentially transfers the scan start signal in the form of a pulse of a turn-on level to a next scan stage under the control of the clock signal.

The pixel unit 14 includes a plurality of pixels. Each pixel PXij may be coupled to a corresponding data line and a corresponding scan line. Here, i and j may be integers greater than 0. The pixel PXij may mean a pixel in which a scan transistor is coupled to an ith scan line and a jth data line.

The pixels may be commonly coupled to a first power line (not shown) and a second power line (not shown). Also, the pixel unit 14 may be divided into blocks. Each block may include two or more pixels commonly coupled to the first power line. The first power line and the blocks will be described with reference to subsequent drawings.

The first power line may be coupled to first power sub-lines DSUBLs. The first power sub-lines DSUBLs may be coupled to corresponding first power sources (not shown). In this embodiment, the data driver 12 may include the first power source. Therefore, the first power sub-lines DSUBLs may be coupled to the data driver 12. In another embodiment, the data driver 12 and the first power sources may be separately configured. For example, the first power sources may be directly coupled to a power management integrated chip (PMIC) instead of the data driver 12. The first power sub-lines DSUBLs may not be coupled to the data driver 12.

The second power line may be coupled to second power sub-lines SSUBLs. The second power sub-lines SSUBLs may be coupled to corresponding second power sources (not shown). In this embodiment, the data driver 12 may include second power sources. Therefore, the second power sub-lines SSUBLs may be coupled to the data driver 12. In an embodiment, the data driver 12 and the second power sources may be separately configured. For example, the second power sources may be directly coupled to a PMIC instead of the data driver 12. The second power sub-lines SSUBLs may not be coupled to the data driver 12.

The first power voltage controller 15 may determine a margin value of a first power voltage supplied to the first power line, based on load values of the blocks. The determined margin value may be transferred to the first power sources. The magnitude of the first power voltage may be determined to become smaller as the margin value become larger. The load values and the margin value will be described with reference to subsequent drawings.

Figure 2:
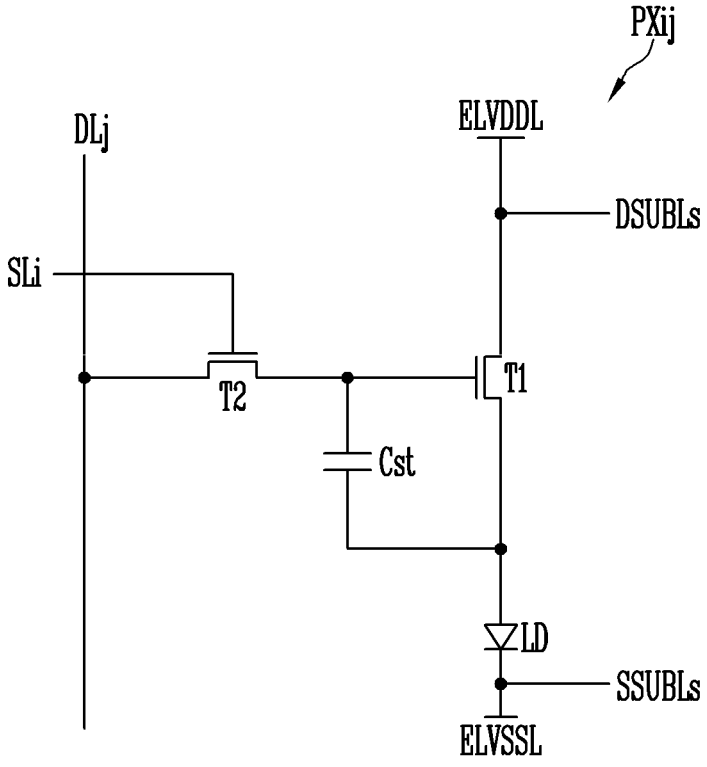
FIG. 2 is a diagram illustrating a pixel in accordance with an embodiment of the present disclosure.

FIG. 2 is a diagram illustrating a pixel in accordance with an embodiment of the present disclosure.

Referring to FIG. 2, the pixel PXij may include transistors T1 and T2, a storage capacitor Cst, and a light emitting diode LD.

Hereinafter, a circuit implemented with a P-type transistor is described as an example. However, those skilled in the art may design a circuit implemented with an N-type transistor by changing the polarity of a voltage applied to a gate terminal. Similarly, those skilled in the art may design a circuit implemented with a combination of the P-type transistor and the N-type transistor. The P-type transistor refers to a transistor in which an amount of current flowing increases when the difference in voltage between a gate electrode and a source electrode increases in a negative direction. The N-type transistor refers to a transistor in which an amount of current flowing increases when the difference in voltage between a gate electrode and a source electrode increases in a positive direction. The transistor may be configured in various forms including a Thin Film Transistor (TFT), a Field Effect Transistor (FET), a Bipolar Junction Transistor (BJT), and the like.

As depicted in FIG. 2, a gate electrode of a first transistor T1 may be coupled to a first electrode of the storage capacitor Cst, a first electrode of the first transistor T1 may be coupled to a first power line ELVDDL, and a second electrode of the first transistor T1 may be coupled to a second electrode of the storage capacitor Cst. The first transistor T1 may be referred to as a driving transistor.

A gate electrode of a second transistor T2 may be coupled to an ith scan line SLi, a first electrode of the second transistor T2 may be coupled to a jth data line DLj, and a second electrode of the second transistor T2 may be coupled to the gate electrode of the first transistor T1. The second transistor T2 may be referred to as a scan transistor.

An anode of the light emitting diode LD may be coupled to the second electrode of the first transistor T1, and a cathode of the light emitting diode LD may be coupled to a second power line ELVSSL. The light emitting diode LD may be configured as an organic light emitting diode, an inorganic light emitting diode, a quantum dot light emitting diode, or the like.

A first power voltage may be applied to the first power line ELVDDL, and a second power voltage may be applied to the second power line ELVSSL.

When a scan signal having a turn-on level (here, a high level) is applied through the scan line SLi, the second transistor T2 is in a turn-on state. A data voltage applied to the data line DLj is stored in the first electrode of the storage capacitor Cst.

A positive driving current corresponding to a difference in voltage between the first electrode and the second electrode of the storage capacitor Cst flows between the first electrode and the second electrode of the first transistor T1. Accordingly, the light emitting diode LD emits light with a luminance corresponding to the data voltage.

Next, when a scan signal having a turn-off level (here, a low level) is applied through the scan line SLi, the second transistor T2 is turned off, and the data line DLj and the first electrode of the storage capacitor Cst is electrically decoupled from each other. Therefore, although the data voltage of the data line DLj is changed, the voltage stored in the first electrode of the storage capacitor Cst is not changed.

Embodiments may be applied not only the pixel PXij shown in FIG. 2 but also a pixel of another circuit.

First sub-power lines DSUBLs may be commonly coupled to the first power line ELVDDL. That is, electrical nodes of the first power line ELVDDL and the first power sub-lines DSUBLs may be shared.

Second power sub-lines SSUBLs may be commonly coupled to the second power line ELVSSL. That is, electrical nodes of the second power line ELVSSL and the second power sub-lines SSUBLs may be shared.

In accordance with the embodiment of the present disclosure, the first transistor T1 may be driven in a saturation state. An amount of driving current may increase as a voltage applied to the gate electrode of the first transistor T1 becomes higher. That is, the first transistor T1 may operate as a current source. A condition in which the first transistor T1 is driven in the saturation state is shown in the following Expression 1.

$$Vds \geq Vgs - Vth \quad \text{Expression 1}$$

Vds is a drain-source voltage difference of the first transistor T1, Vgs is a gate-source voltage difference of the first transistor T1, and Vth is a threshold voltage of the first transistor T1.

The light emitting diode OLED may emit light with a high luminance as the amount of driving current increases. Therefore, when an image with a high grayscale is displayed, there is required a gate voltage higher than that when an image with a low grayscale is displayed. That is, when an image with a high grayscale is displayed, there is required a first power voltage higher than that when an image with a low grayscale is displayed.

When the display device 10 supplies a minimum first power voltage required to display an image frame (when the equality sign of Expression 1 is satisfied), power consumption can be minimized.

Figure 3:
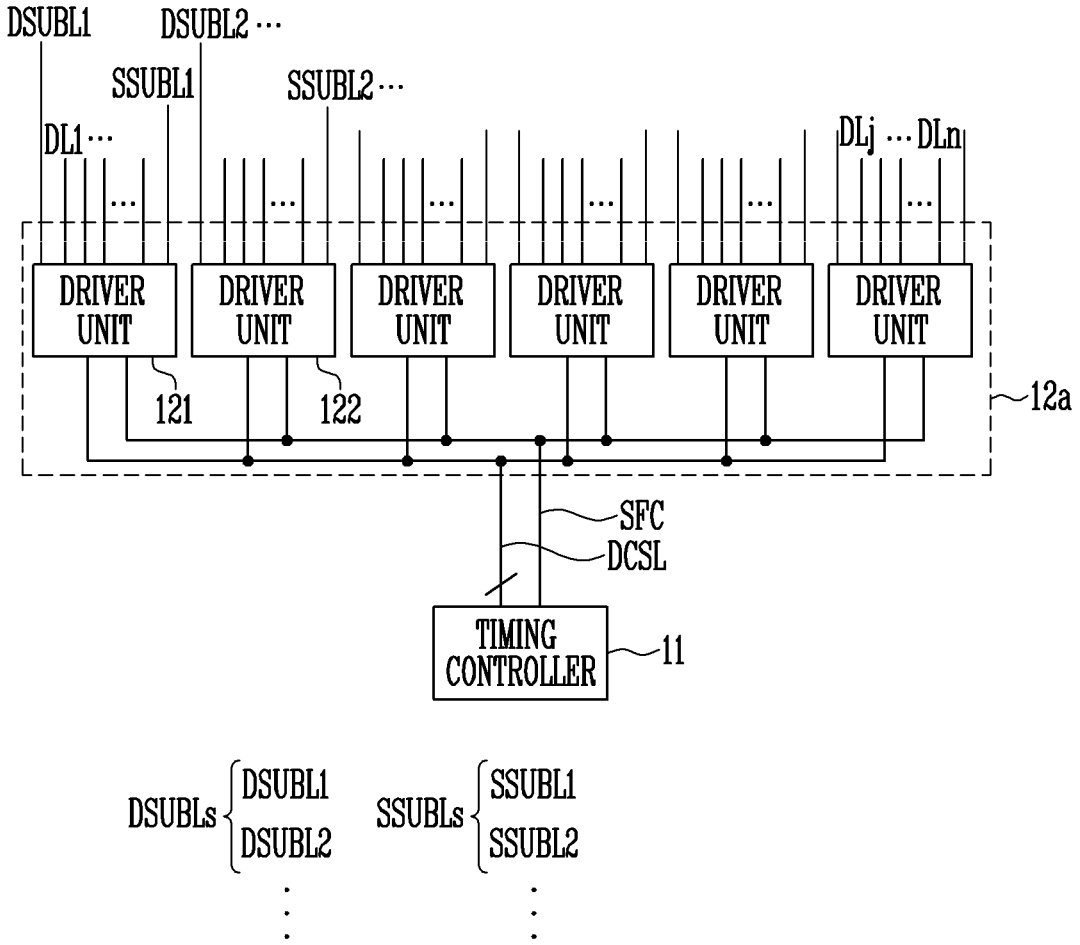
FIG. 3 is a diagram illustrating a data driver in accordance with an embodiment of the present disclosure.

FIG. 3 is a diagram illustrating a data driver in accordance with an embodiment of the present disclosure.

Referring to FIG. 3, a first data driver 12*a* in accordance with the embodiment of the present disclosure may include a plurality of driver units 121 and 122. When the display device 10 includes the plurality of driver units 121 and 122, the data lines DL1 to DLn may be grouped into data line groups, and each data line group may be coupled to a corresponding driver unit.

The driver units 121 and 122 may use one clock training line SFC as a common bus line. For example, the timing controller 11 may simultaneously transfer a signal notifying that a clock training pattern is to be supplied to all the driver units 121 and 122 through one clock training line SFC.

The driver units 121 and 122 may be coupled to the timing controller 11 through dedicated clock data lines DCSL. For example, when the display device 10 includes the plurality of driver units 121 and 122, the driver units 121 and 122 may be coupled to the timing controller 11 through the respective clock data lines DCSL.

At least one clock data line DCSL may be coupled to each of the driver units 121 and 122. For example, a plurality of clock data lines DCSL may be coupled to each driver unit so as to prepare for a case where it is insufficient to achieve a desired bandwidth of a transmission signal by using only one clock data line DCSL. In addition, each driver unit may require a plurality of clock data lines DCSL, even when the clock data line DCSL is configured as a differential signal line so as to remove a common mode noise. Each of the driver units 121 and 122 may include a first power source and a second power source. Each of the first power sources may be coupled to at least one of first power sub-lines DSUBLs. Each of the second power sources may be coupled to at least one of second power sub-lines SSUBLs. Each of the first power sources may supply a first power voltage through the first power sub-line. Each of the second power sources may supply a second power voltage through the second power sub-line.

For example, the driver unit 121 may supply the first power voltage to the first power line ELVDDL through a first power sub-line DSUBL1, and supply the second power voltage to the second power line ELVSSL through a second power sub-line SSUBL1. Similarly, the driver unit 122 may supply the first power voltage to the first power line ELVDDL through a first power sub-line DSUBL2, and supply the second power voltage to the second power line ELVSSL through a second power sub-line SSUBL2.

Figure 4:
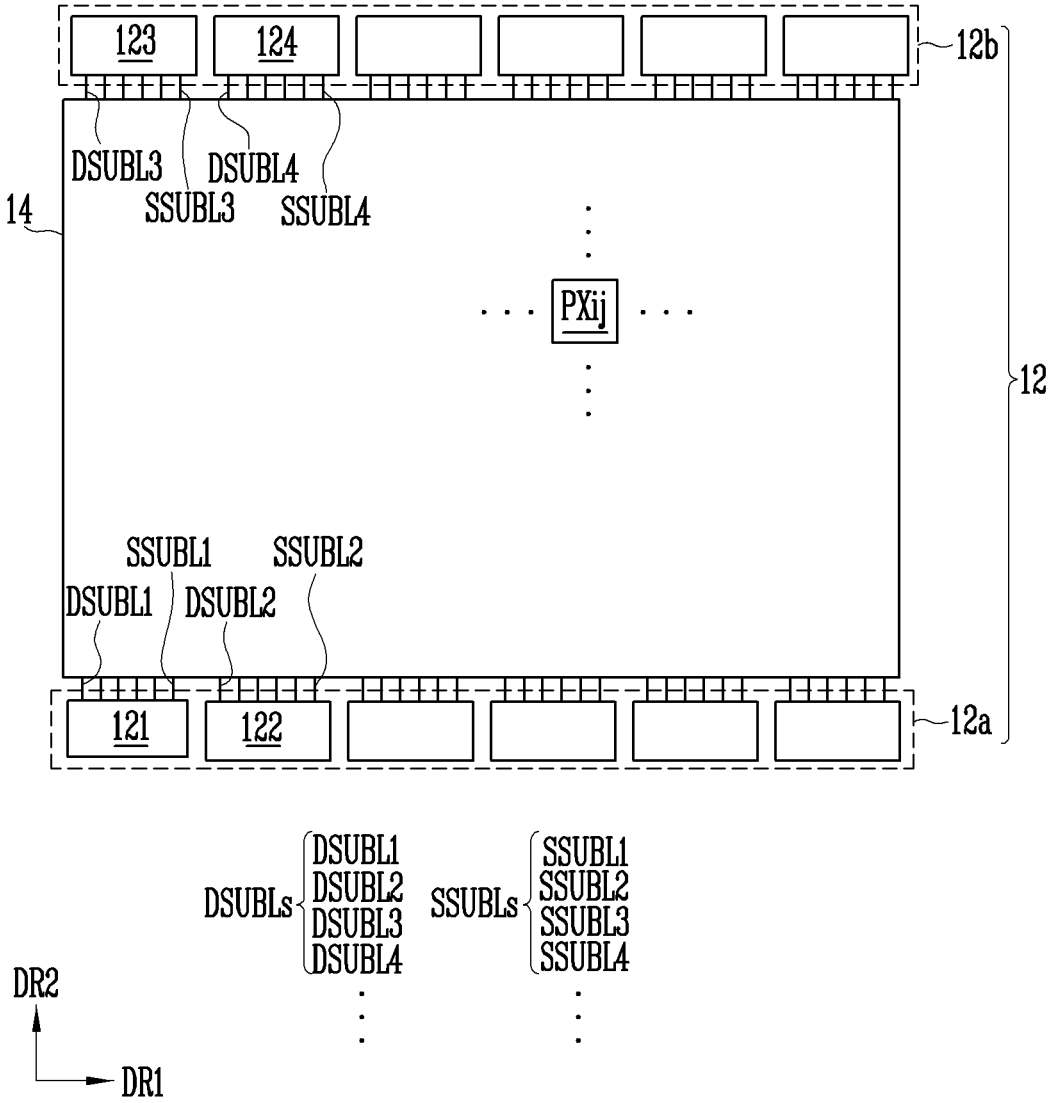
FIG. 4 is a diagram illustrating an arrangement of a pixel unit and the data driver in accordance with an embodiment of the present disclosure.

FIG. 4 is a diagram illustrating an arrangement of the pixel unit and the data driver in accordance with an embodiment of the present disclosure.

As depicted in FIG. 4, the data driver 12 includes a first data driver 12*a* and a second data driver 12*b*.

The pixel unit 14 may have a planar shape extending in a first direction DR1 and a second direction DR2 perpendicular to the first direction DR1. In this embodiment, for convenience of description, the pixel unit 14 is provided in a rectangular shape as an example. However, in another embodiment, the pixel unit 14 may be provided in a circular shape, an elliptical shape, a rhombus shape, or the like. Also, the pixel unit 14 may have a planar shape of which a portion is changed when the pixel unit 14 is curved, foldable, or rollable.

The first data driver 12*a* may be in parallel with the pixel unit 14 and located along the first direction DR1. The first data driver 12*a* may include a plurality of driver units 121 and 122. The driver units 121 and 122 may include first power sub-lines DSUBL1 and DSUBL2 and second power sub-lines SSUBL1 and SSUBL2, which extend in the second direction DR2. The first power sub-lines DSUBL1 and DSUBL2 may be arranged in the first direction DR1. The second power sub-lines SSUBL1 and SSUBL2 may be arranged in the first direction DR1.

The second data driver 12*b* may be in parallel with the pixel unit 12 and located along the first direction DR1. The second data driver 12*b* may include a plurality of driver units 123 and 124. The driver units 123 and 124 may include first power sub-lines DSUBL3 and DSUBL4 and second power sub-lines SSUBL3 and SSUBL4, which extend in the second direction DR2. The first power sub-lines DSUBL3 and DSUBL4 may be arranged in the first direction DR1. The second power sub-lines SSUBL3 and SSUBL4 may be arranged in the first direction DR1.

FIG. 5, FIG. 6, FIG. 7, and FIG. 8 are diagrams illustrating example patterns of image frames. FIG. 9 is a diagram illustrating minimum first power voltages required with respect to the patterns shown in FIG. 5, FIG. 6, FIG. 7, and FIG. 8.

Figure 5:
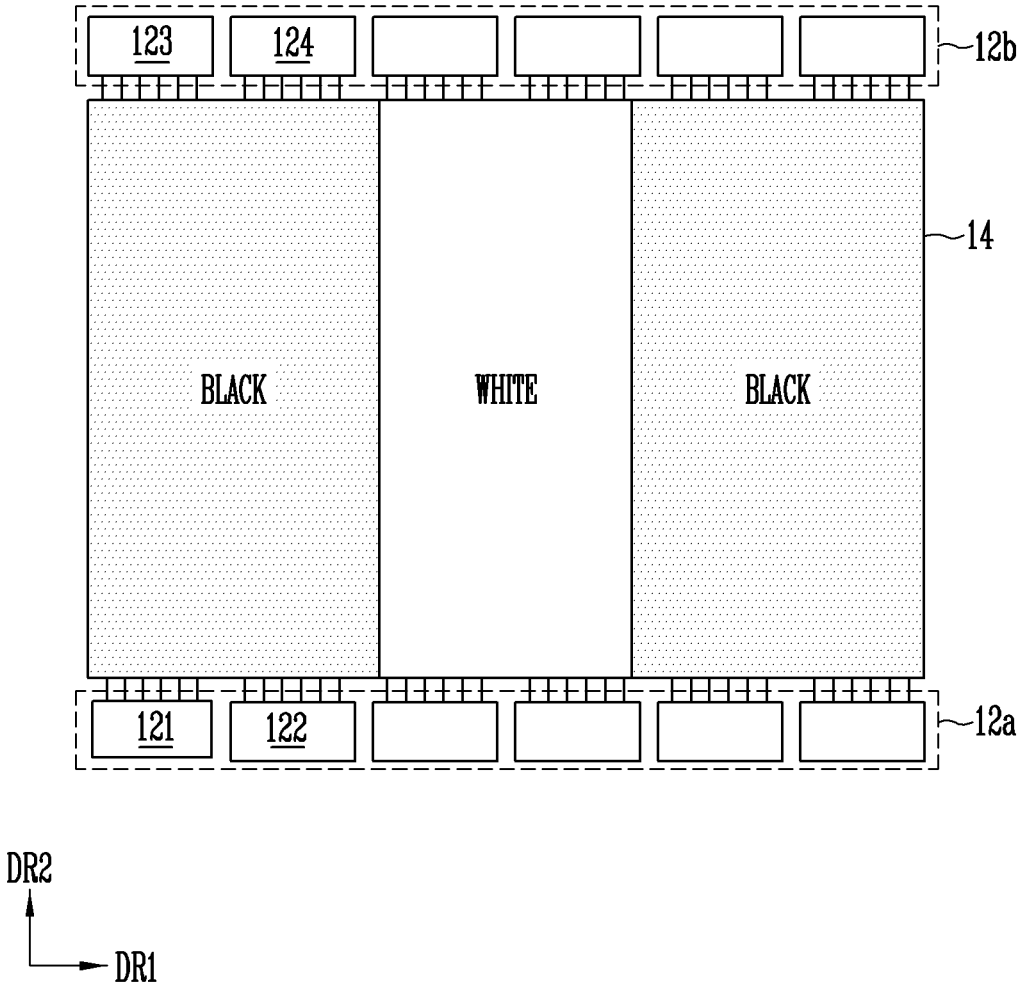
FIG. 5, FIG. 6, FIG. 7, and FIG. 8 are diagrams illustrating example patterns of image frames.

Referring to FIG. 5, an image frame having pattern "A" may be displayed in the pixel unit 14. The pattern "A" has a black grayscale, a white grayscale, and the black grayscale, which sequentially alternate with respect to the first direction DR1, and has no grayscale change with respect to the second direction DR2.

Figure 6:
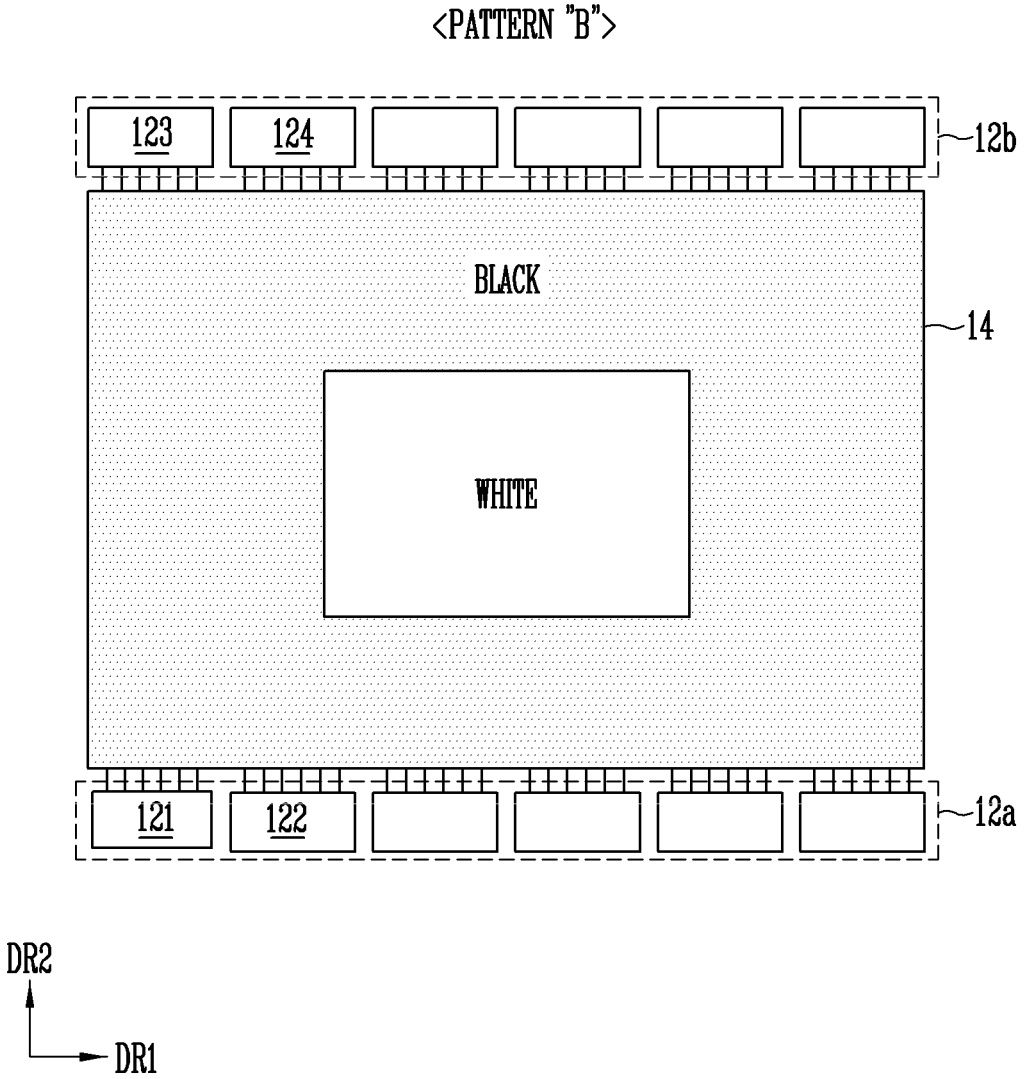

Referring to FIG. 6, an image frame having pattern "B" may be displayed in the pixel unit 14. The pattern "B" has the black grayscale, the white grayscale, and the black grayscale, which sequentially alternate with respect to the first direction DR1, and has the black grayscale, the white grayscale, and the black grayscale, which sequentially alternate with respect to the second direction DR2. In the pattern "B," a number of pixels displaying the white grayscale may equal to that of pixels displaying the white grayscale in the pattern "A."

Figure 7:
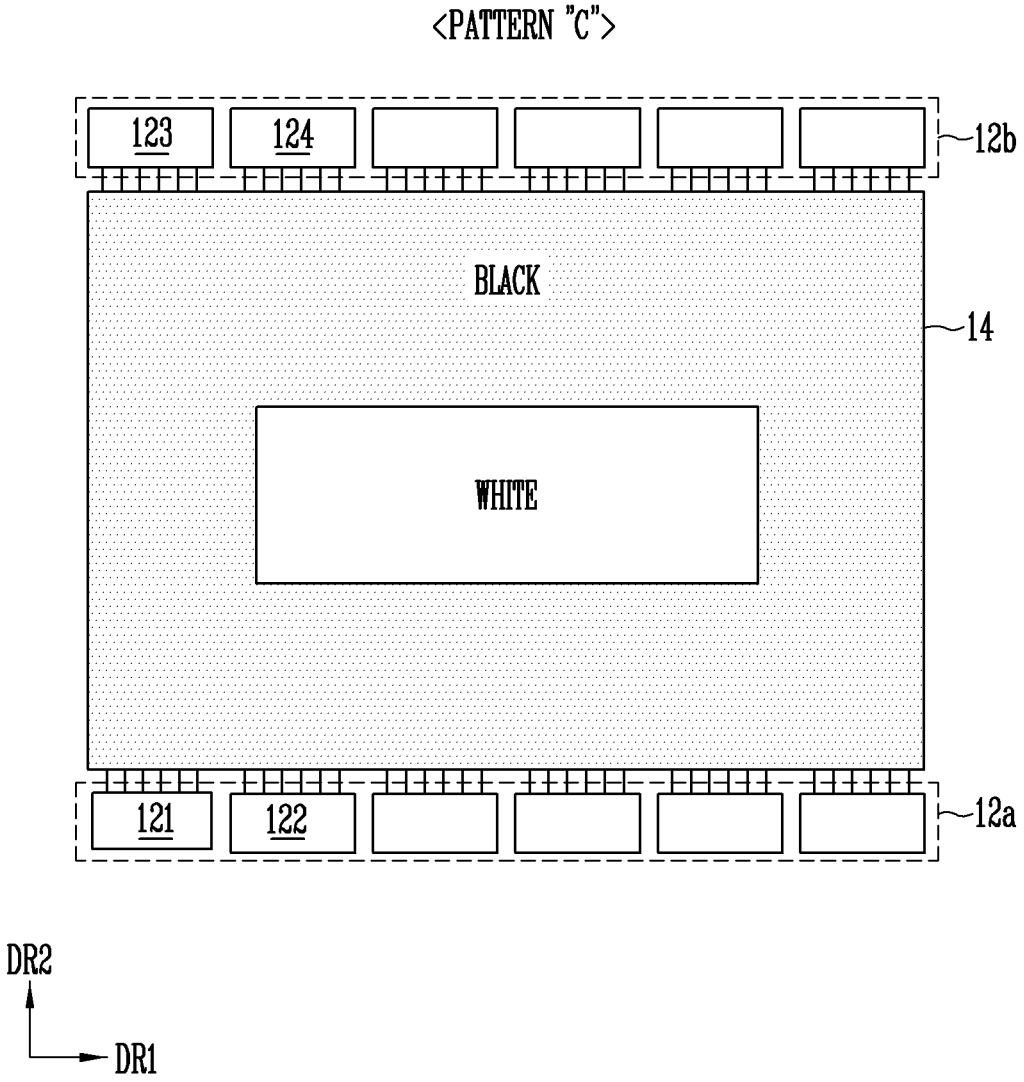

Referring to FIG. 7, an image frame having pattern "C" may be displayed in the pixel unit 14. The pattern "C" has the black grayscale, the white grayscale, and the black grayscale, which sequentially alternate with respect to the first direction DR1, and has the black grayscale, the white grayscale, and the black grayscale, which sequentially alternate with respect to the second direction DR2. As compared with the pattern "B," the pattern "C" may have a white grayscale area of which length in the first direction DR1 is longer than that of the pattern "B," and have the white grayscale area of which length in the second direction DR2 is shorter than that of the pattern "B." A number of pixels displaying the white grayscale in the pattern "C" may be equal to those of pixels displaying the white grayscale in the patterns "A" and "B."

Figure 8:
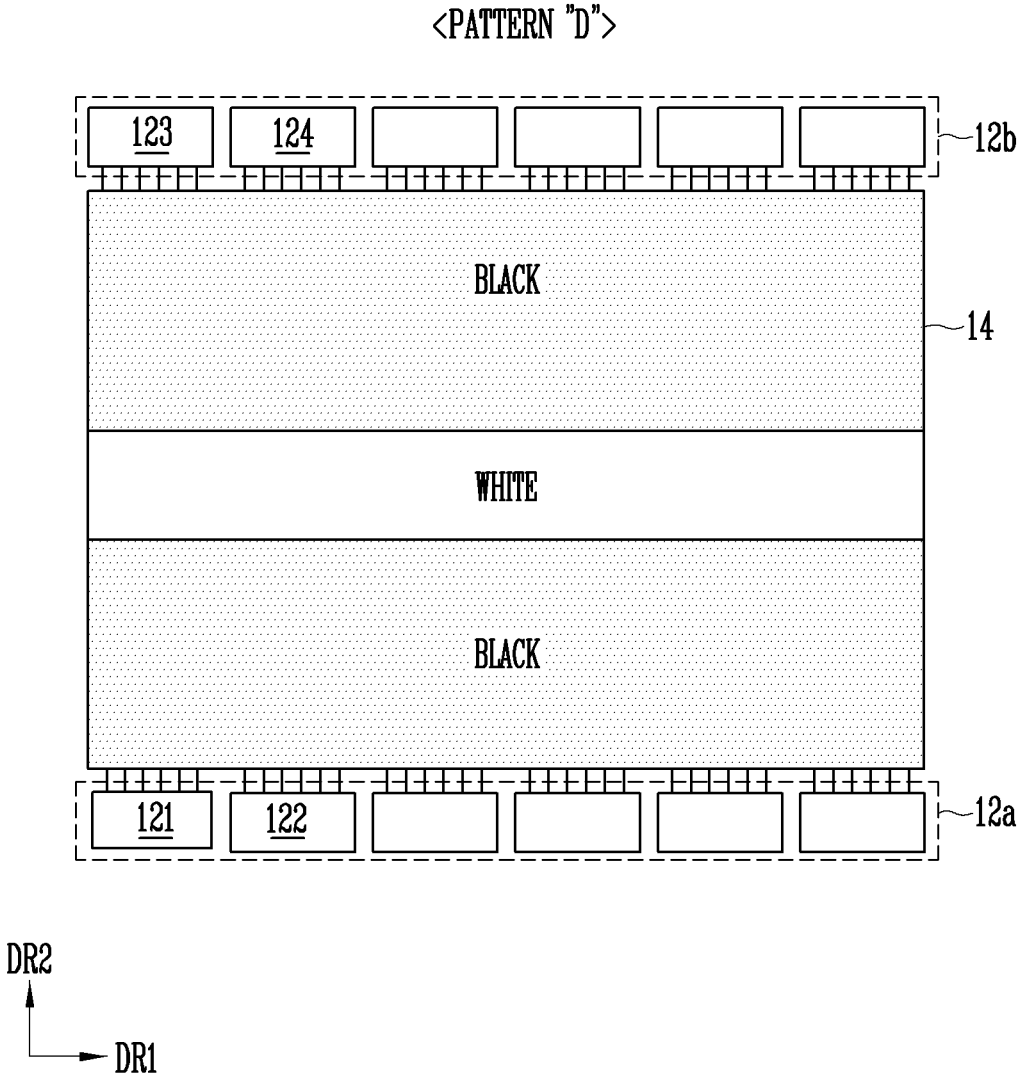
Figure 9:
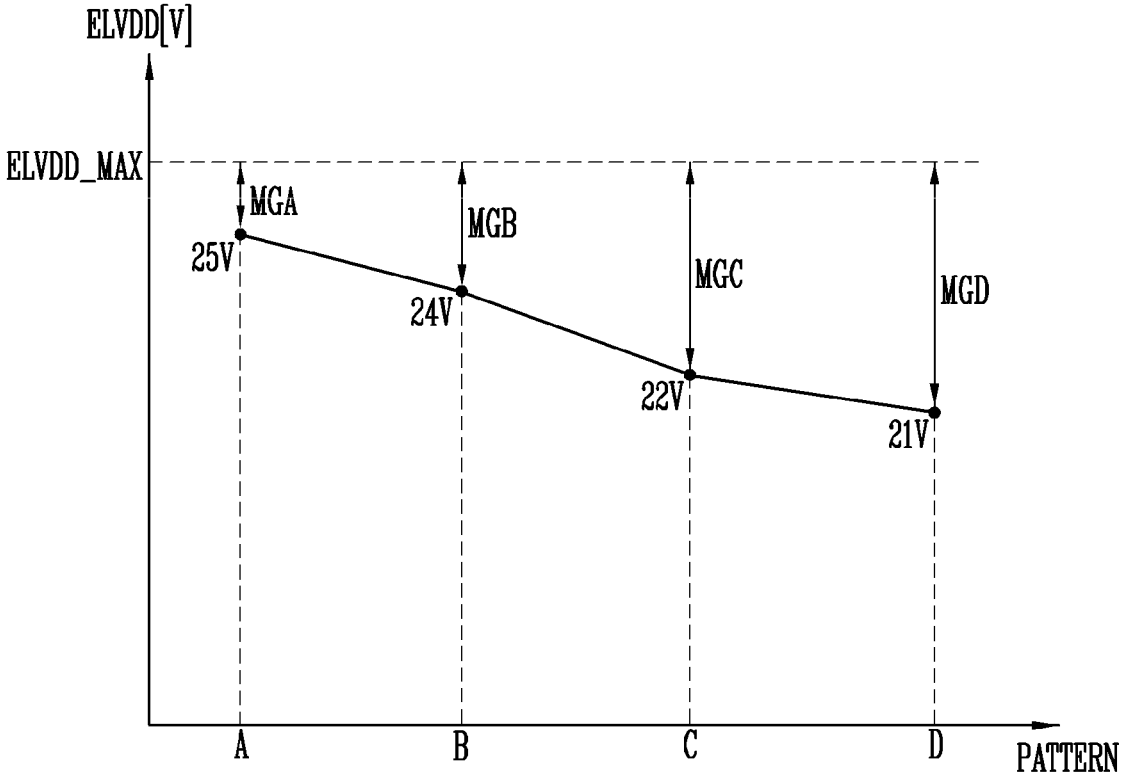
FIG. 9 is a diagram illustrating minimum first power voltages required with respect to the patterns shown in FIGS. 5 to 8.

Referring to FIG. 8, an image frame having pattern "D" may be displayed in the pixel unit 14. The pattern "D" has no grayscale change with respect to the first direction DR1, and has the black grayscale, the white grayscale, and the black grayscale, which sequentially alternate with respect to the second direction DR2. A number of pixels displaying the white grayscale in the pattern "D" may be equal to those of pixels displaying the white grayscale in the patterns "A," "B," and "C."

Referring to FIG. 9, it can be seen that a minimally required first power voltage ELVDD decreases with respect to an order of "A," "B," "C," and "D." For example, the first power voltage ELVDD for displaying the pattern "A" may be 25V, the first power voltage ELVDD for displaying the pattern "B" may be 24V, the first power voltage ELVDD for displaying the pattern "C" may be 22V, and the first power voltage ELVDD for displaying the pattern "D" may be 21V.

This is because, since numbers of the driver units 121, 122, 123, and 124 driven with respect to the order of "A," "B," "C," and "D" increase, resistance values of the driver units 121, 122, 123, and 124 facing each other decrease, and consequently, the amount of IR drop decreases.

Thus, it can be seen that, based on a maximum value ELVDD_MAX of the first power voltage ELVDD, allowable margin values MGA, MGB, MGC, and MGD of the first power voltage ELVDD increase with respect to the order of "A," "B," "C," and "D." That is, a lower first power voltage ELVDD can be supplied as the margin value becomes larger.

Accordingly, it can be seen that, when a larger margin value is calculated as the white grayscale area of the image frame is more widely distributed, the power consumption of the display device 10 can be reduced.

In FIG. 5, FIG. 6, FIG. 7, FIG. 8, and FIG. 9, a case where the display device 10 includes 12 driver units 121, 122, 123, and 124 is illustrated as an example. However, the embodiment of the present disclosure may be applied to even when the display device 10 includes at least two driver units.

For example, first pixels may be commonly coupled to the first power line ELVDDL, and be coupled to data lines of a first group. Second pixels may be commonly coupled to the first power line ELVDDL, and be coupled to data lines of a second group. The data lines of the first group and the data lines of the second group may be different from each other.

A first driver unit may be coupled to the first power line ELVDDL through a first power sub-line, and be coupled to the data lines of the first group. A second driver unit may be coupled to the first power line ELVDDL through a second power sub-line, and be coupled to the data lines of the second group. The second power sub-line is a term to be distinguished from the first power sub-line, and does not mean that the second power sub-line is coupled to the second power line ELVSSL.

A first voltage may be supplied to the first power line ELVDDL in a first pattern in which X pixels among the first pixels and Y pixels among the second pixels emit light, and the other pixels among the first pixels and the other pixels among the second pixels do not emit light. In addition, a second voltage may be supplied to the first power line ELVDDL in a second pattern in which Z pixels among the first pixels emit light, and the other pixels among the first pixels and all the second pixels do not emit light. The second voltage may be higher than the first voltage. Here, X, Y, and Z may be integers greater than 0, and satisfy Z=X+Y.

For example, the X pixels, the Y pixels, and the Z pixels may emit light, based on the same grayscale values. A first luminance when the display device 10 displays the first pattern and a second luminance when the display device 10 displays the second pattern may be equal to each other.

For example, when the first pattern is the pattern "D," the second pattern may be any one of the patterns "A," "B," and "C." For example, when the first pattern is the pattern "C," the second pattern may be any one of the patterns "A" and "B." For example, when the first pattern is the pattern "B," the second pattern may be the pattern "A."

Although the above-described embodiment has been described with respect to the first power line ELVDDL, the above-described embodiment may be described with respect to the second power line ELVSSL.

Figure 10:
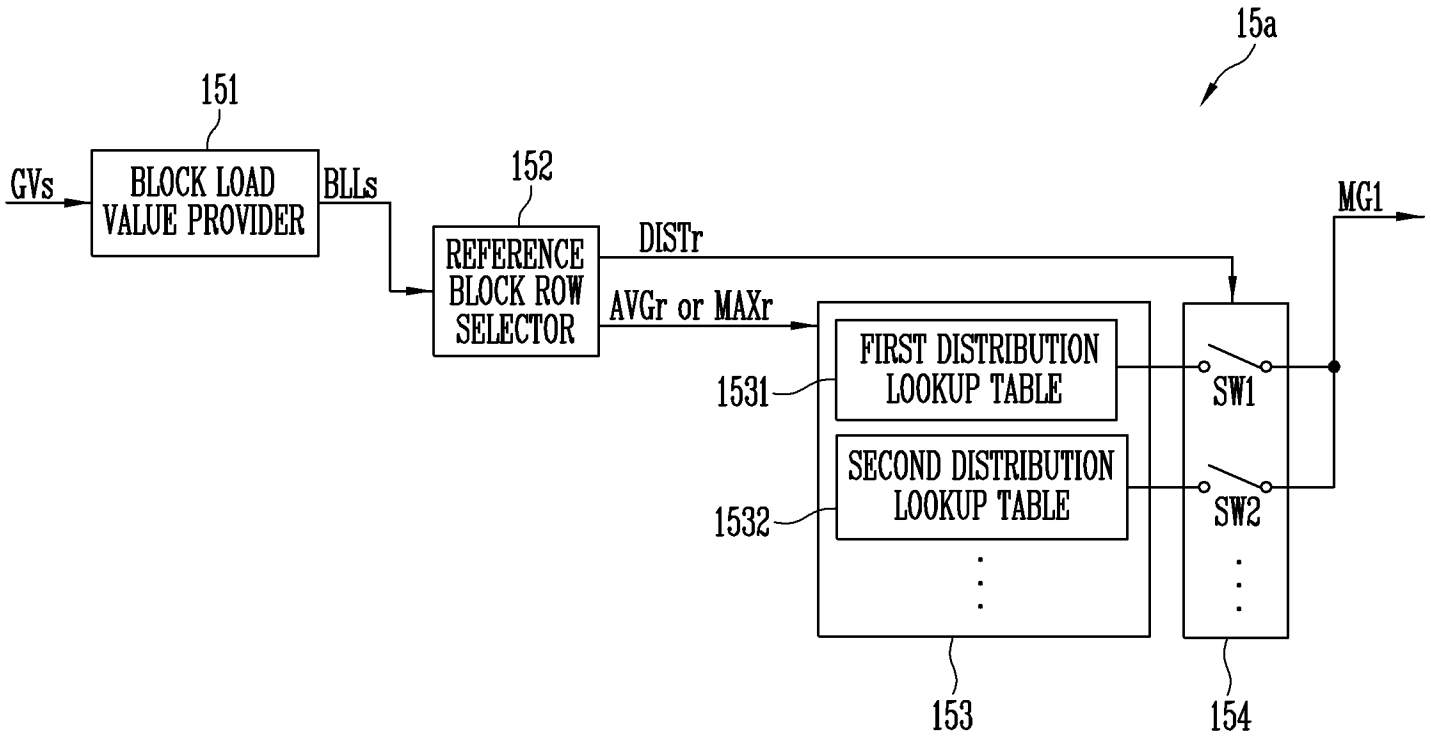
FIG. 10 is a diagram illustrating a first power voltage controller in accordance with an embodiment of the present disclosure.
Figure 11:
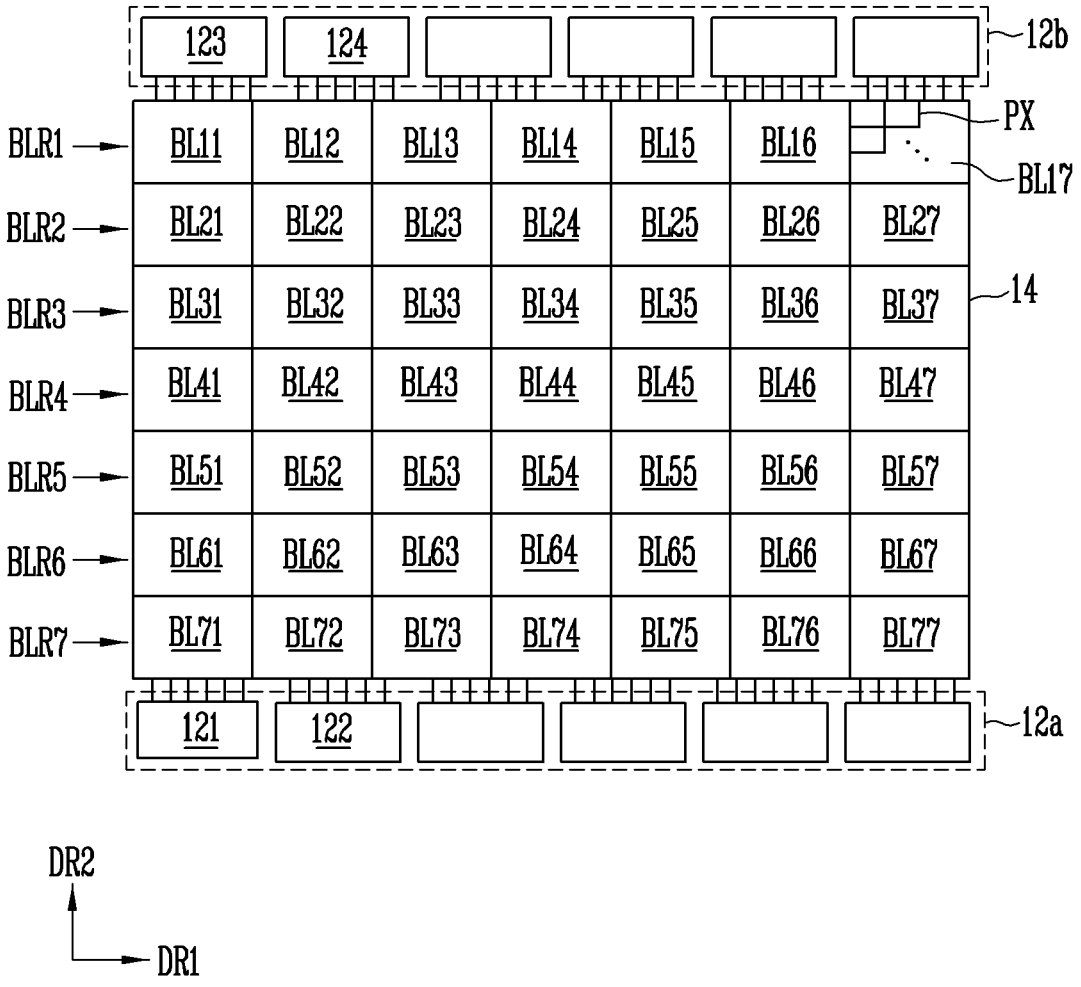
FIG. 11 is a diagram illustrating a reference block row selector in accordance with an embodiment of the present disclosure.
Figure 12:
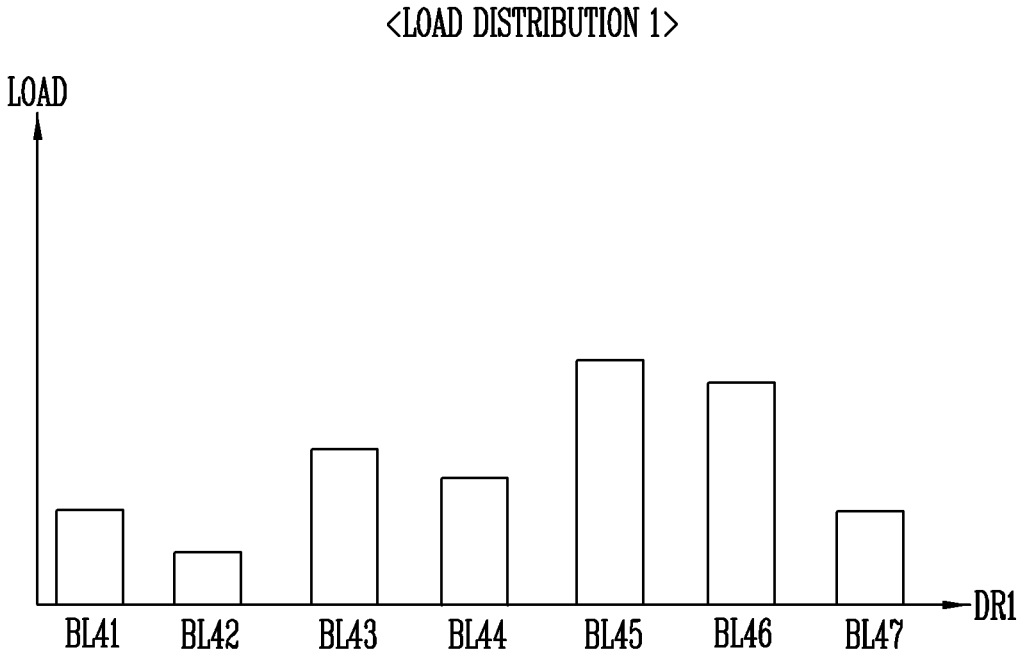
FIG. 12, FIG. 13, and FIG. 14 are diagrams illustrating distribution lookup tables in accordance with an embodiment of the present disclosure.
Figure 13:
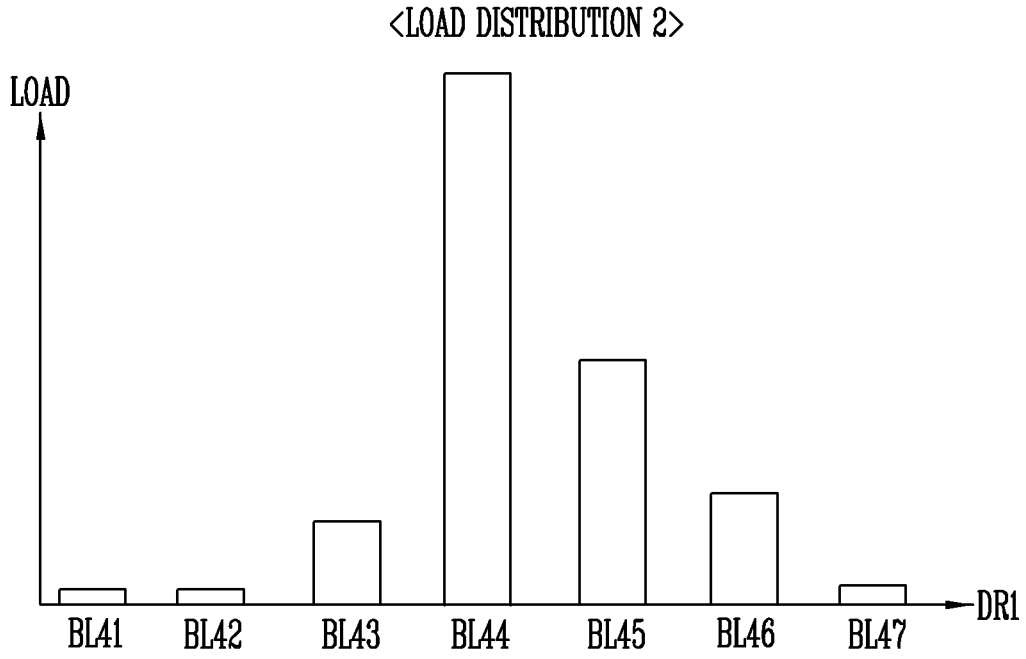
Figure 14:
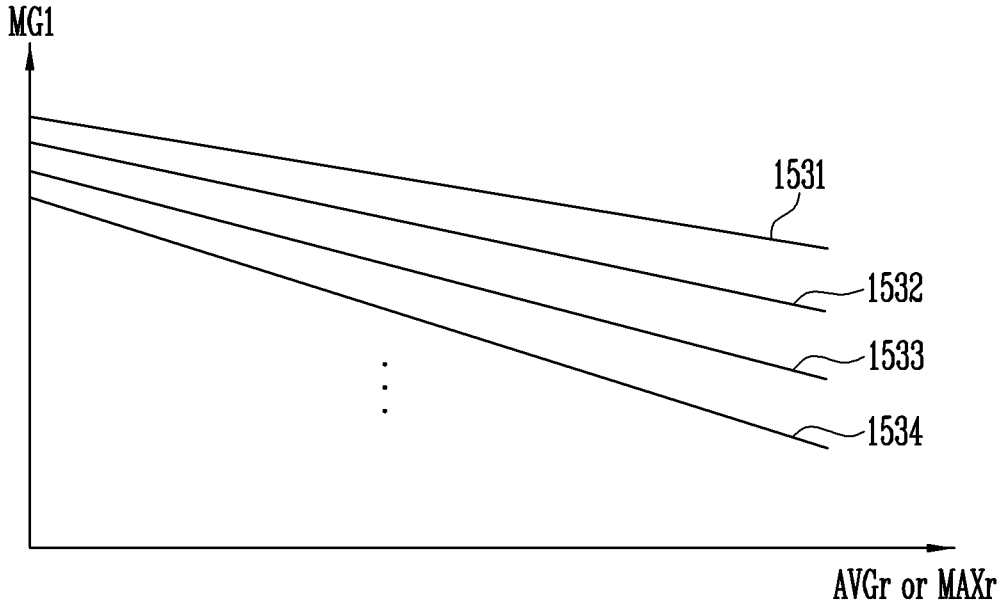

FIG. 10 is a diagram illustrating a first power voltage controller in accordance with an embodiment of the present disclosure. FIG. 11 is a diagram illustrating a reference block row selector in accordance with an embodiment of the present disclosure. FIG. 12, FIG. 13, and FIG. 14 are diagrams illustrating distribution lookup tables in accordance with an embodiment of the present disclosure.

Referring to FIG. 10, the first power voltage controller 15*a* may include a block load value provider 151, a reference block row selector 152, a first memory 153, and a first switch unit 154.

In an embodiment, as shown in FIG. 10, the first power voltage controller 15*a* may be an IC chip configured with a plurality of sub-units 151, 152, 153, and 154, which are divided in a hardware manner. In another embodiment, the first power voltage controller 15*a* may be an IC chip configured with the plurality of sub-units 151, 152, 153, and 154, which are divided in a software manner. In still another embodiment, at least some of the sub-units 151, 152, 153, and 154 of the first power voltage controller 15*a* may be integrated or be further subdivided. In still another embodiment, the first power voltage controller 15*a* may be configured as a portion (hardware or software) of the timing controller 11. In still another embodiment, the first power voltage controller 15*a* may be configured as a portion (hardware or software) of the data driver 12. As described above, the first power voltage controller 15*a* may be configured in various forms within a range for achieving an object of the present disclosure. The above-described contents may be equally applied to embodiments will be described later.

The first power voltage controller 15*a* may determine a first margin value MG1 according to a degree of distribution of load values of first blocks BL41, BL42, BL43, BL44, BL45, BL46, and BL47 arranged in the first direction DR1 among blocks. The first power voltage controller 15*a* may determine the first margin value MG1 to become larger such that the load values of first blocks BL41 to BL47 can be distributed more widely in the first direction DR1. For example, the first power voltage controller 15*a* may determine the first margin value MG1 to become larger as the variation or standard deviation of the load values of first blocks BL41 to BL47 becomes smaller.

The block load value provider 151 may receive grayscale values GVs for an image frame, and provide load values BLLs of blocks BL11 to BL77, based on the grayscale values GVs. For example, the block load value provider 151 may calculate a load value of the block 17 by adding up grayscale values GVs corresponding to pixels PX included in the block BL17.

The block load value provider 151 may apply different weights to grayscale values GVs of different colors. For example, the block load value provider 151 may calculate a load value by multiplying red grayscale values by a weight of 1.2, multiplying green grayscale values by a weight of 0.8, multiplying blue grayscale values by a weight of 1.0, and then adding up the multiplied grayscale values. In another embodiment, the block load value provider 151 may apply the same weight to grayscale values GVs of different colors.

The reference block row selector 152 may receive load values BLLs, and select a reference block row, based on the load values BLLs. Each of block rows BLR1, BLR2, BLR3, BLR4, BLR5, BLR6, and BLR7 may be a set of blocks arranged in the first direction DR1. For example, the block row BLR4 may include the blocks BL41, BL42, BL43, BL44, BL45, BL46, and BL47.

First, the reference block row selector 152 may calculate an average value and a maximum value of load values with respect to each of the block rows BLR1 to BLR7. The reference block row selector 152 may determine, as candidates of the reference block row, a first block row having the highest average value and a second block row having the highest maximum value. For example, the reference block row selector 152 may determine the first block row as the reference block row when the following Expression 2 is satisfied, and determine the second block row as the reference block row when the following Expression 2 is not satisfied.

$$AVG_LD2+REF_LD \leq AVG_LD1 \quad \text{Expression 2}$$

AVG_LD2 may be an average value of the second block row, REF_LD may be a predetermined value as a reference load value, and AVG_LD1 may be an average value of the first block row.

That is, when the average value of the first block row is greater than or equal to a value obtained by adding up the average value of the second block row and the reference load value, the reference block row selector 152 may determine the first block row as the reference block row. When the average value of the first block row is smaller than the value obtained by adding up the average value of the second block row and the reference load value, the reference block row selector 152 may determine the second block row as the reference block row.

In another embodiment, the reference block row selector 152 may calculate an average value of load values with respect to each of the block rows BLR1 to BLR7, and determine a block row having the highest average value as the reference block row.

In still another embodiment, the reference block row selector 152 may calculate a maximum value of load values with respect to each of the block rows BLR1 to BLR7, and determine a block row having the highest maximum value as the reference block row.

Next, the reference block row selector 152 may provide a degree DISTr of distribution of load values of the selected reference block row. For example, a case where the selected reference block row is the block row BLR4 is assumed. The load values of the first blocks BL41 to BL47 included in the block row BLR4 may be distributed as shown in FIG. 12 or be distributed as shown in FIG. 13. It can be seen that, as compared with the case shown in FIG. 13, the load values of the first blocks BL41 to BL47 in the case shown in FIG. 12 are distributed widely in the first direction DR1. Thus, as compared with the case shown in FIG. 13, the reference block row selector 152 can provide a large degree DISTr of distribution in the case shown in FIG. 12.

The degree DISTr of distribution can be calculated using various methods. For example, the degree DISTr of distribution may be calculated using a variation or standard deviation. For example, it may be determined that the degree DISTr of distribution becomes larger as the variation or standard deviation becomes smaller. Those skilled in the art may calculate the degree DISTr of distribution by using other statistical methods.

Also, the reference block row selector 152 may provide an average value AVGr or maximum value MAXr of the load values of the selected reference block row. For example, when the first block row is determined as the reference block row, the reference block row selector 152 may provide an average value AVGr of the first blocks BL41 to BL47. For example, when the second block row is determined as the reference block row, the reference block row selector 152 may provide a maximum value MAXr of the first blocks BL41 to BL47.

The first memory 153 may include a plurality of distribution lookup tables 1531, 1532, . . . . The first switch unit 154 may include a plurality of switches SW1, SW2, . . . . The switch unit 154 may select any one of the plurality of distribution lookup tables 1531, 1532, . . . according to the received degree DISTr of distribution. For example, the first switch unit 154 may select a distribution lookup table 1531 which provides an averagely higher first margin value MG1 as the degree DISTr of distribution becomes larger. For example, the first switch unit 154 may select a distribution lookup table 1534 which provides an averagely lower first margin value MG1 as the degree DISTr of distribution becomes smaller.

Each of the distribution lookup tables 1531, 1532, 1533, 1534, . . . may be predetermined to provide a smaller first margin value MG1 as the average value AVGr or maximum value MAXr of the load values of the first blocks BL41 to BL47 becomes larger.

In the above-described embodiments, the first power voltage controller 15*a* considers only an average value and a maximum value of load values. However, in another embodiment, the first power voltage controller 15*a* may consider another parameter such as a minimum value of load values.

Figure 15:
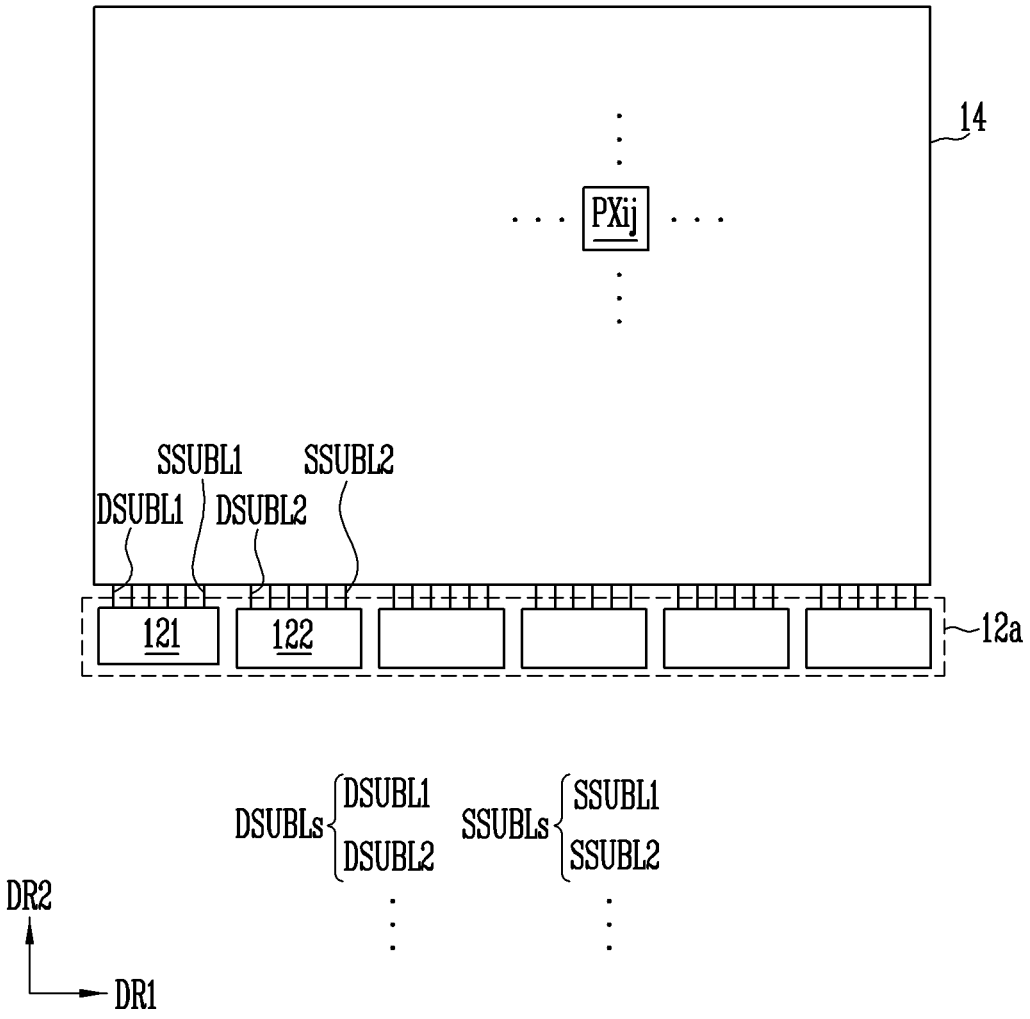
FIG. 15 is a diagram illustrating an arrangement of the pixel unit and the data driver in accordance with another embodiment of the present disclosure.
Figure 16:
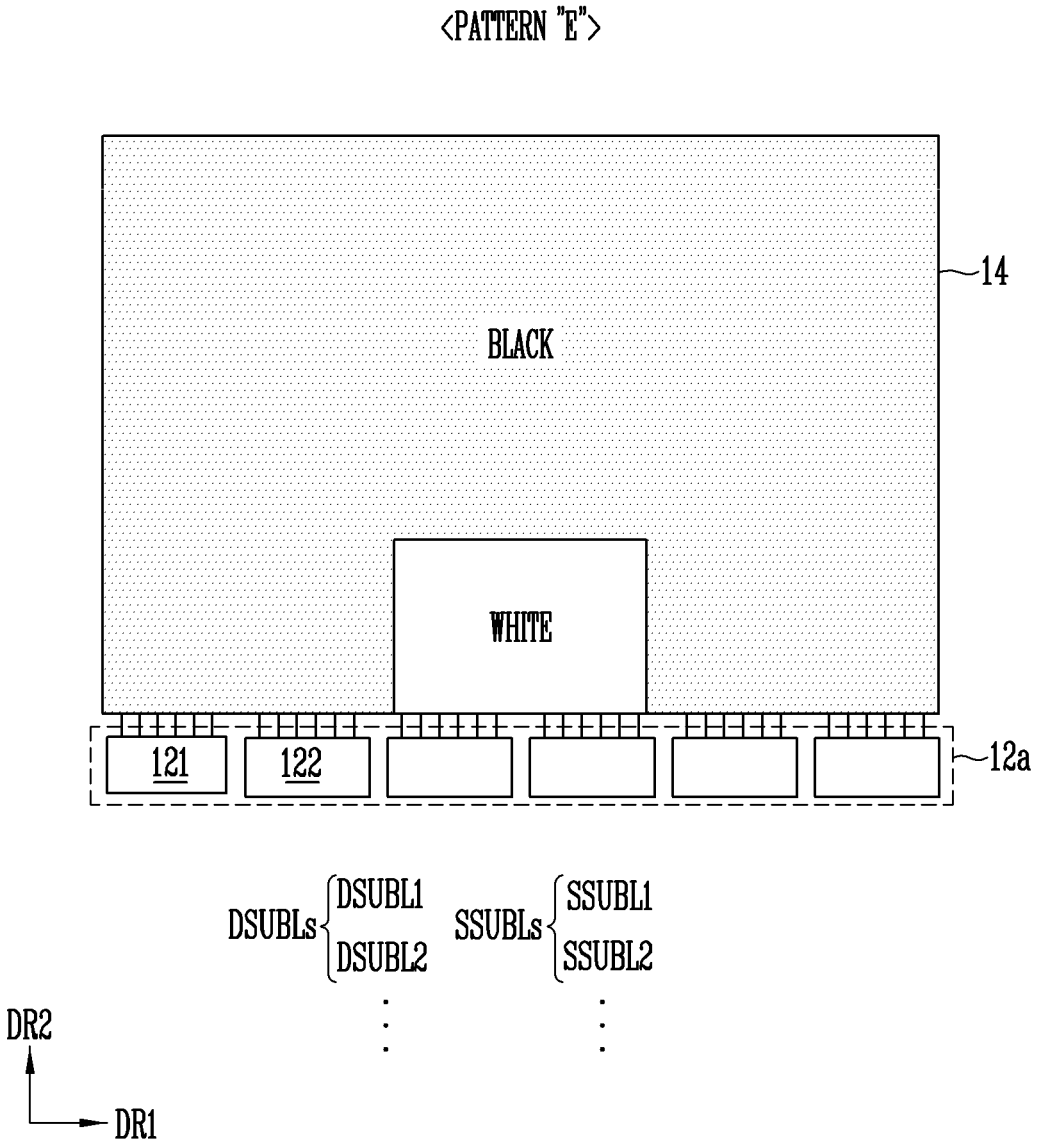
FIG. 16, FIG. 17, and FIG. 18 are diagrams illustrating example patterns of image frames.
Figure 18:
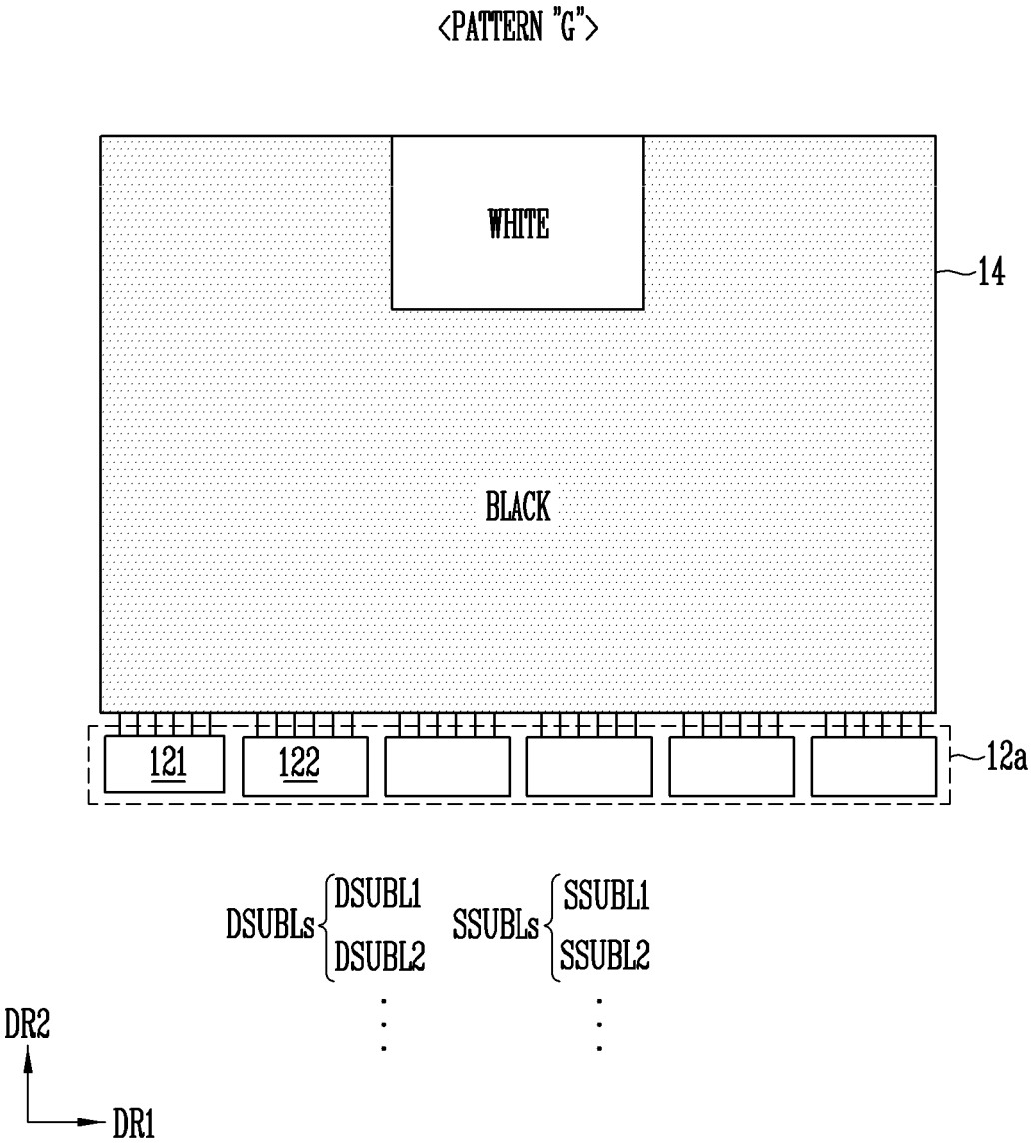
Figure 19:
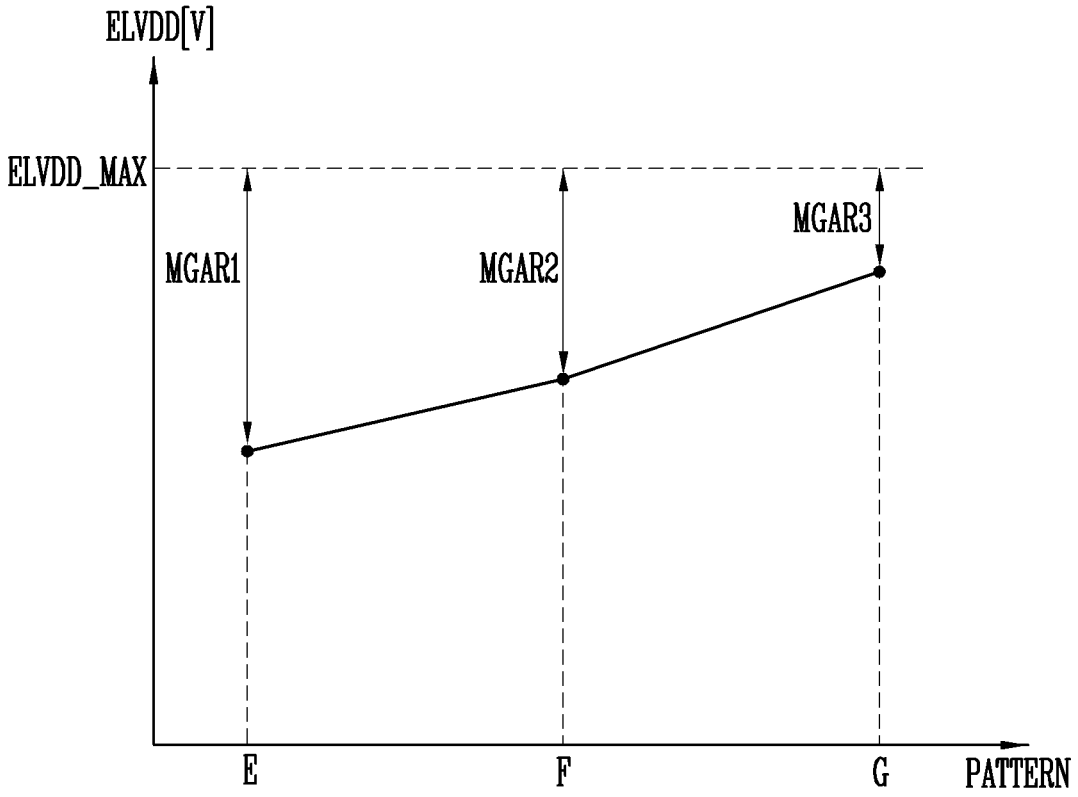
FIG. 19 is a diagram illustrating minimum first power voltages required with respect to the patterns shown in FIGS. 16 to 18.

FIG. 15 is a diagram illustrating an arrangement of the pixel unit and the data driver in accordance with another embodiment of the present disclosure. FIGS. 16 and 18 are diagrams illustrating exemplary patterns of image frames. FIG. 19 is a diagram illustrating minimum first power voltages required with respect to the patterns shown in FIG. 16, FIG. 17, and FIG. 18.

As compared with the embodiment shown in FIG. 4, in the embodiment shown in FIG. 15, the data driver 12 includes the first data driver 12*a*, but does not include the second data driver 12*b*.

Referring to FIG. 16, an image frame having pattern "E" may be displayed in the pixel unit 14. The pattern "E" has the black grayscale, the white grayscale, and the black grayscale, which sequentially alternate with respect to the first direction DR1, and has the white grayscale relatively close to the first power sub-lines DSUBLs with respect to the second direction DR2.

Figure 17:
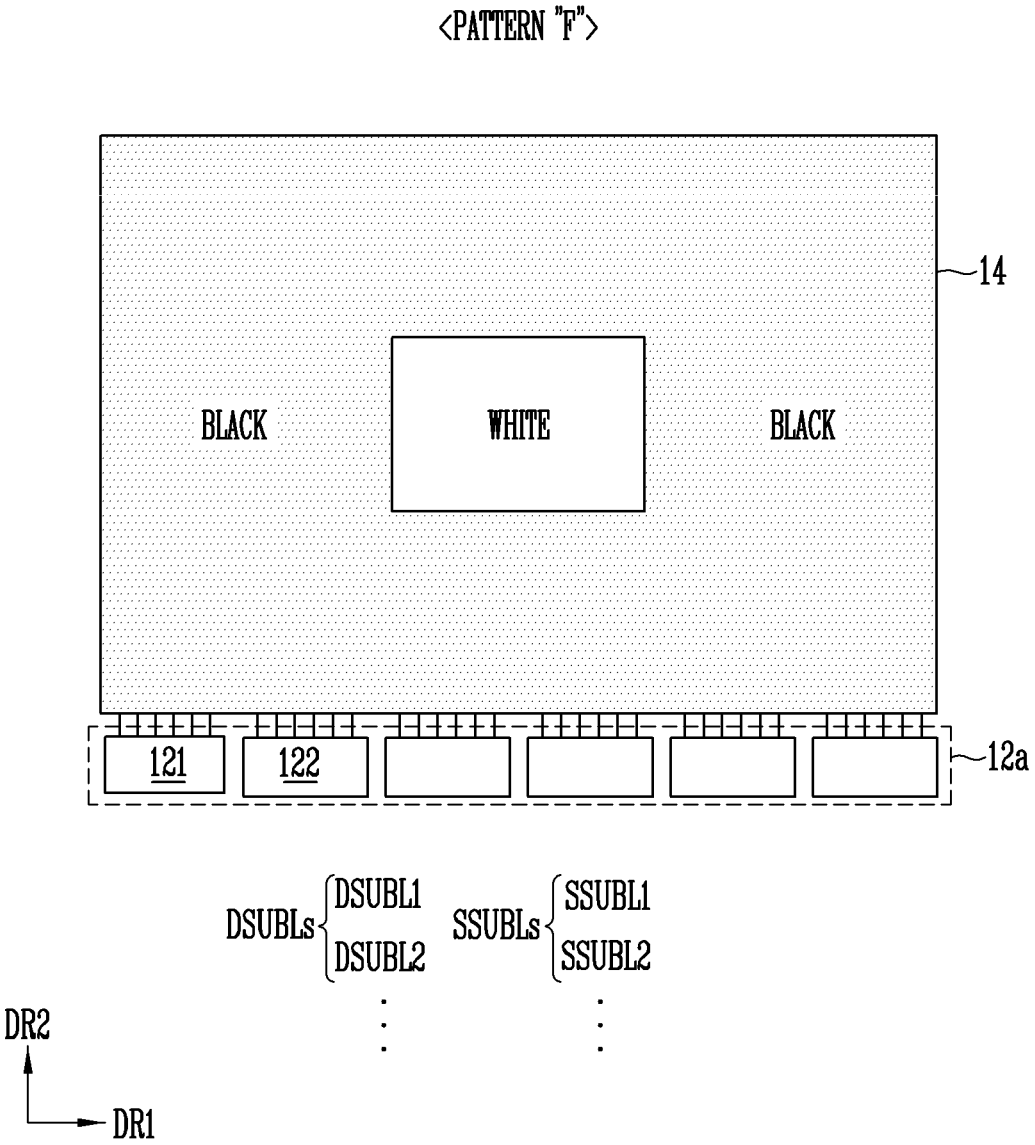

Referring to FIG. 17, an image frame having pattern "F" may be displayed in the pixel unit 14. The pattern "F" has the black grayscale, the white grayscale, and the black grayscale, which sequentially alternate with respect to the first direction DR1, and has a white grayscale area spaced apart from the first power sub-lines DSUBLs at a distance with respect to the second direction DR2. A number of pixels displaying the white grayscale in the pattern "F" may be equal to that of pixels displaying the white grayscale in the pattern "E."

Referring to FIG. 18, an image frame having pattern "G" may be displayed in the pixel unit 15. The pattern "G" has the black grayscale, the white grayscale, and the black grayscale, which sequentially alternate with respect to the first direction DR1, and has a white grayscale area relatively distant from the first power sub-lines DSUBLs with respect to the second direction DR2. A number of pixels displaying the white grayscale in the pattern "G" may be equal to those of pixels displaying the white grayscale in the patterns "E" and "F."

Referring to FIG. 19, it can be seen that a minimally required first power voltage ELVDD decreases with respect to an order of "G," "F," and "E." This is because, since the white grayscale area become close to the first power sub-lines DSUBLs with respect to the order of "G," "F," and "E", the amount of IR drop decreases.

Thus, it can be seen that, based on a maximum value ELVDD_MAX of the first power voltage ELVDD, allowable margin values MGAR1, MGAR2, and MGAR3 of the first power voltage ELVDD increase with respect to the order of "E," "F," and "G." That is, a lower first power voltage ELVDD can be supplied as the margin value becomes larger.

Accordingly, it can be seen that, when a large margin value is calculated as the white grayscale area becomes close to first power sub-lines DSUBLs, the power consumption of the display device 10 can be reduced.

Figure 20:
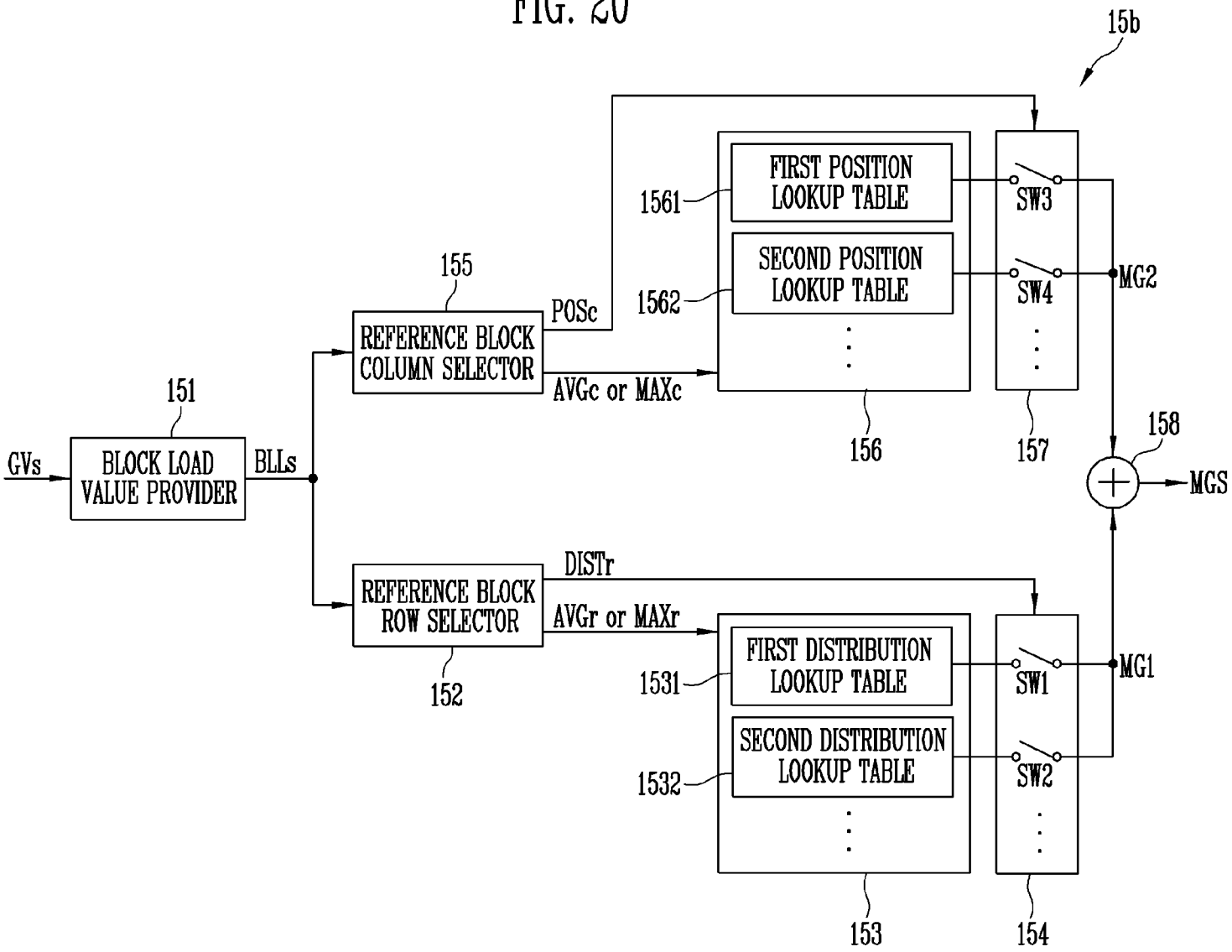
FIG. 20 is a diagram illustrating a first power voltage controller in accordance with another embodiment of the present disclosure.
Figure 21:
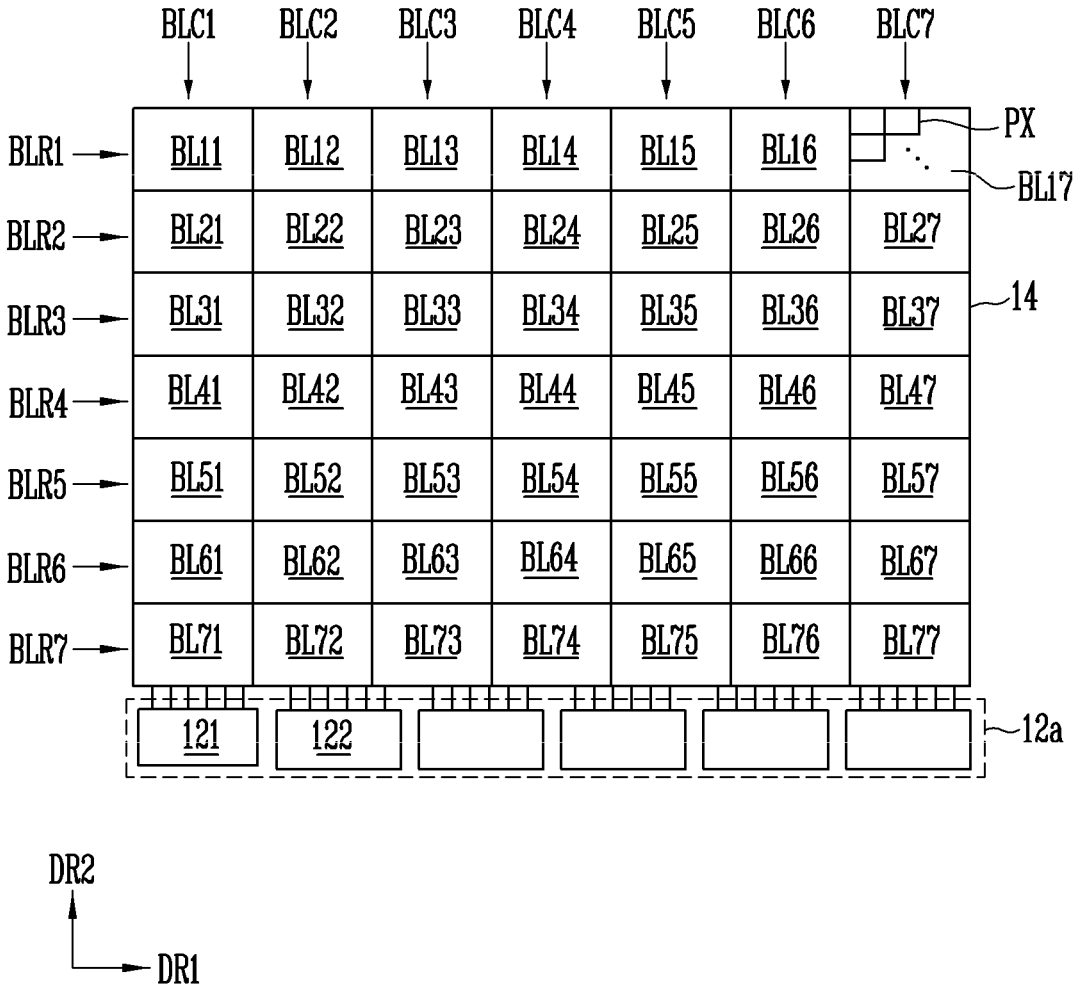
FIG. 21 is a diagram illustrating a reference block column selector in accordance with an embodiment of the present disclosure.
Figure 22:
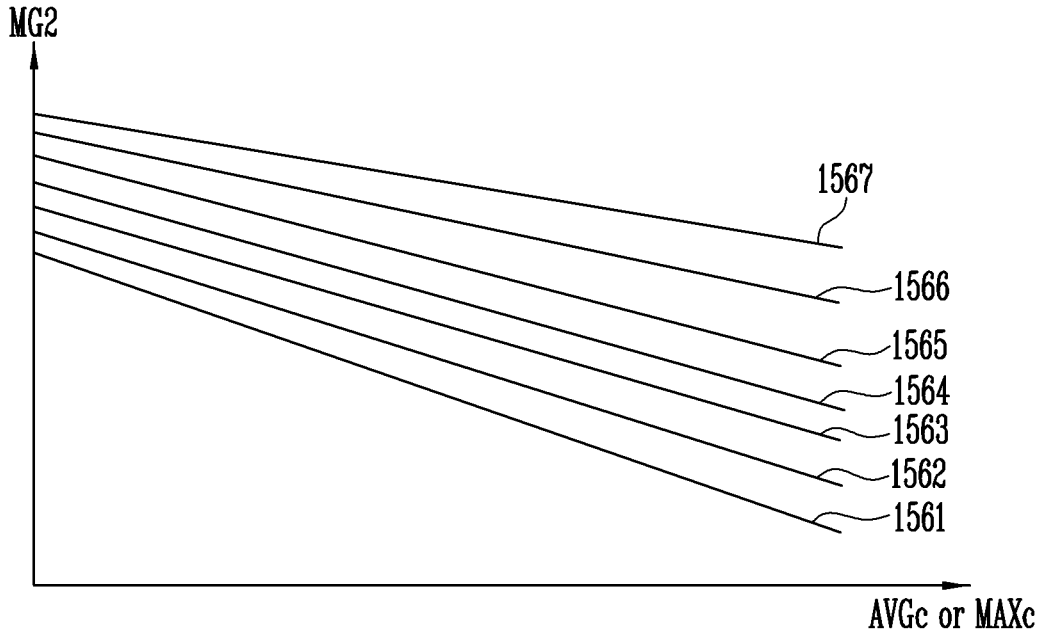
FIG. 22 is a diagram illustrating position lookup tables in accordance with an embodiment of the present disclosure.

FIG. 20 is a diagram illustrating a first power voltage controller in accordance with another embodiment of the present disclosure. FIG. 21 is a diagram illustrating a reference block column selector in accordance with an embodiment of the present disclosure. FIG. 22 is a diagram illustrating position lookup tables in accordance with an embodiment of the present disclosure.

Referring to FIG. 20, the first power voltage controller 15*b* in accordance with the another embodiment of the present disclosure may include a block load value provider 151, a reference block row selector 152, a first memory 153, a first switch unit 154, a reference block column selector 155, a second memory 156, a second switch unit 157, and a adder 158. Any similar or the same descriptions of the block load value provider 151, the reference block row selector 152, the first memory 153 and the first switch unit 154 will be omitted.

The first power voltage controller 15*b* may determine a second margin value MG2 according to a position of a second block having a maximum value among load values of second blocks arranged in the second direction DR2 among blocks. The first power voltage controller 15*b* may determine the second margin value MG2 to become larger as the position of the second block having the maximum value becomes closer to the first power sub-lines DSUBLs.

The reference block column selector 155 may receive load values BLLs, and select a reference block column, based on the load values BLLs. Each of block columns BLC1, BLC2, BLC3, BLC4, BLC5, BLC6, and BLC7 may be a set of blocks arranged in the second direction DR2. For example, the block column BLC3 may include blocks BL13, BL23, BL33, BL43, BL53, BL63, and BL73.

First, the reference block column selector 155 may calculate an average value and a maximum value of load values with respect to each of the block columns BLC1 to BLC7. The reference block column selector 155 may determine, as candidates of the reference block column, a first block column having the highest average value and a second block column having the highest maximum value. For example, the reference block column selector 155 may determine the first block column as the reference block column when the following Expression 3 is satisfied, and determine the second block column as the reference block column row when the following Expression 3 is not satisfied.

$$AVG_LD2c+REF_LDc \leq AVG_LD1c \quad \text{Expression 3}$$

AVG_LD2*c* may be an average value of the second block column, REF_LDc may be a predetermined value as a reference load value, and AVG_LD1*c* may be an average value of the first block column.

That is, when the average value of the first block column is greater than or equal to a value obtained by adding up the average value of the second block column and the reference load value, the reference block column selector 155 may determine the first block column as the reference block column. When the average value of the first block column is smaller than the value obtained by adding up the average value of the second block column and the reference load value, the reference block column selector 155 may determine the second block column as the reference block column.

In another embodiment, the reference block column selector 155 may calculate an average value of load values with respect to each of the block columns BLC1 to BLC7, and determine a block column having the highest average value as the reference block column.

In still another embodiment, the reference block column selector 155 may calculate a maximum value of load values with respect to each of the block columns BLC1 to BLC7, and determine a block column having the highest maximum value as the reference block column.

Next, the reference block column selector 155 may provide a position POSc of a second block a maximum value among load values of the selected reference block column. For example, when the selected reference block column is the block column BLC3, the reference block column selector 155 may provide a position POSc of a second block having a maximum value among load values of the second blocks BL13, BL23, BL33, BL43, BL53, BL63, and BL73.

Furthermore, the reference block column selector 155 may provide an average value AVGc or maximum value MAXc of the load values of the selected reference block column. For example, the first block column is determined as the reference block column, the reference block column selector 155 may provide an average value AVGc of the second blocks BL13 to BL73. For example, when the second block column is determined as the reference block column, the reference block column selector 155 may provide a maximum value MAXc of the second blocks BL13 to BL73.

The second memory 156 may include a plurality of position lookup tables 1561, 1562, 1563, 1564, 1565, 1566, and 1567. The second switch unit 157 may include a plurality of switches SW3, SW4, . . . . The second switch unit 157 may select any one of the plurality of position lookup tables 1561 to 1567. For example, the second switch unit 157 may select a position lookup table 1567 which provides an averagely higher second margin MG2 as the position POSc of the second block having the maximum value becomes closer to the first power sub-line DSUBLs. For example, the second switch unit 157 may select a position lookup table 1561 which provides an averagely lower second margin MG2 as the position POSc of the second block having the maximum value becomes more distant from the first power sub-line DSUBLs.

Each of the position lookup tables 1561 to 1567 may be predetermined to provide a smaller second margin value MG2 as the average value AVGc or maximum value MAXc of the load values of the second blocks BL13 to BL73 becomes larger.

In the above-described embodiments, the first power voltage controller 15*b* considers only an average value and a maximum value of load values. However, in another embodiment, the first power voltage controller 15*b* may consider another parameter such as a minimum value of load values.

The adder 158 may output a final margin value MGS by adding up the first margin value MG1 and the second margin value MG2. For example, the adder 158 may apply the same weight to the first margin value MG1 and the second margin value MG2, or apply different weights to the first margin value MG1 and the second margin value MG2. In other cases, the weight may be 0.

Figure 23:
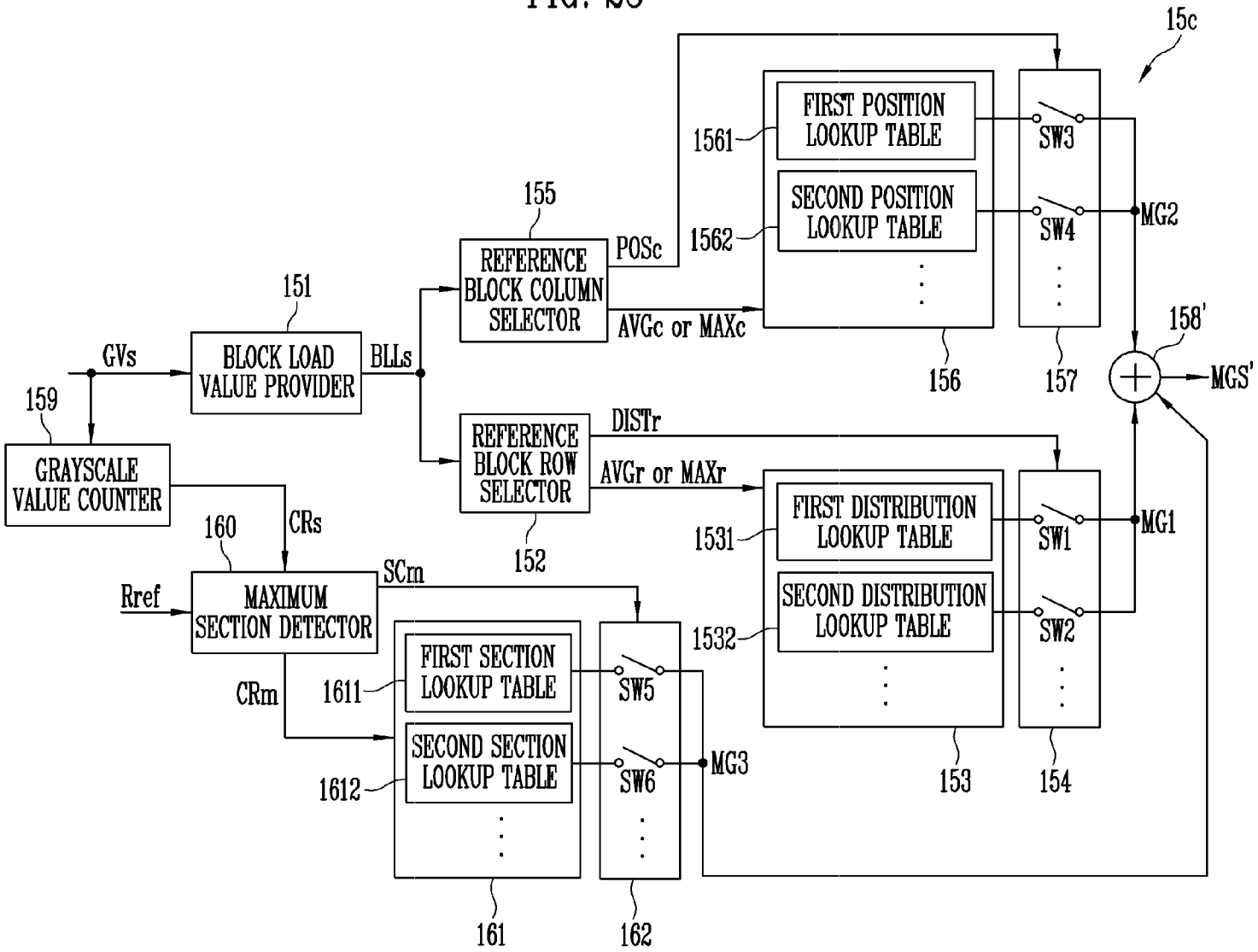
FIG. 23 is a diagram illustrating a first power voltage controller in accordance with still another embodiment of the present disclosure.
Figure 24:
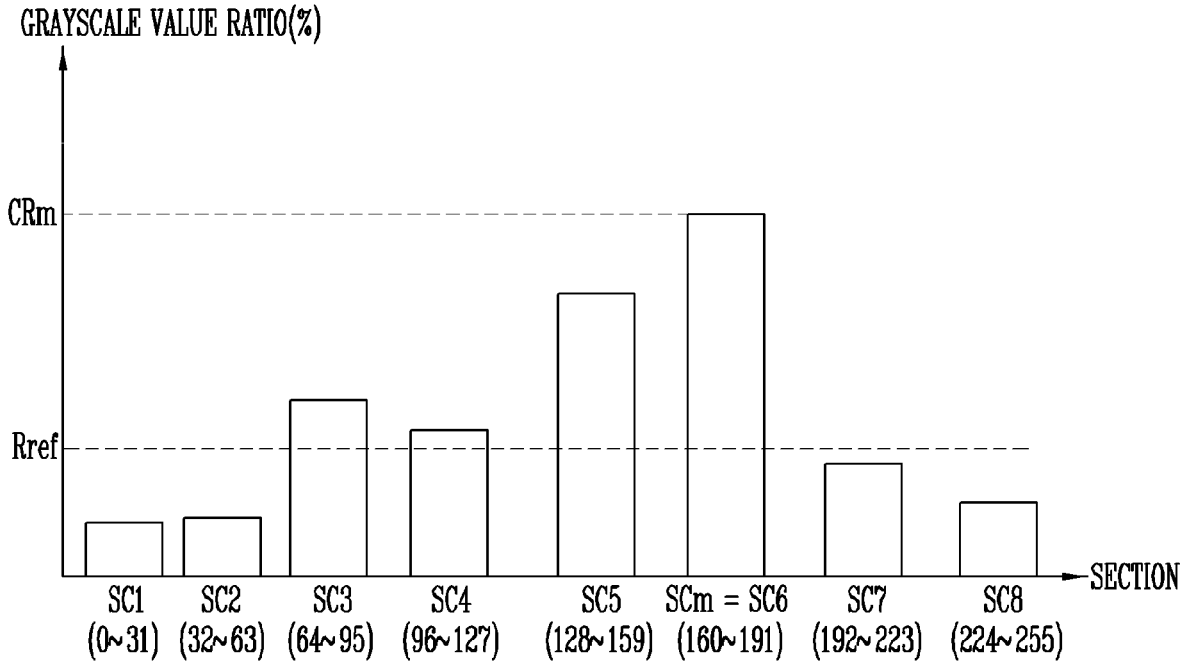
FIG. 24 is a diagram illustrating a maximum section detector in accordance with an embodiment of the present disclosure.
Figure 25:
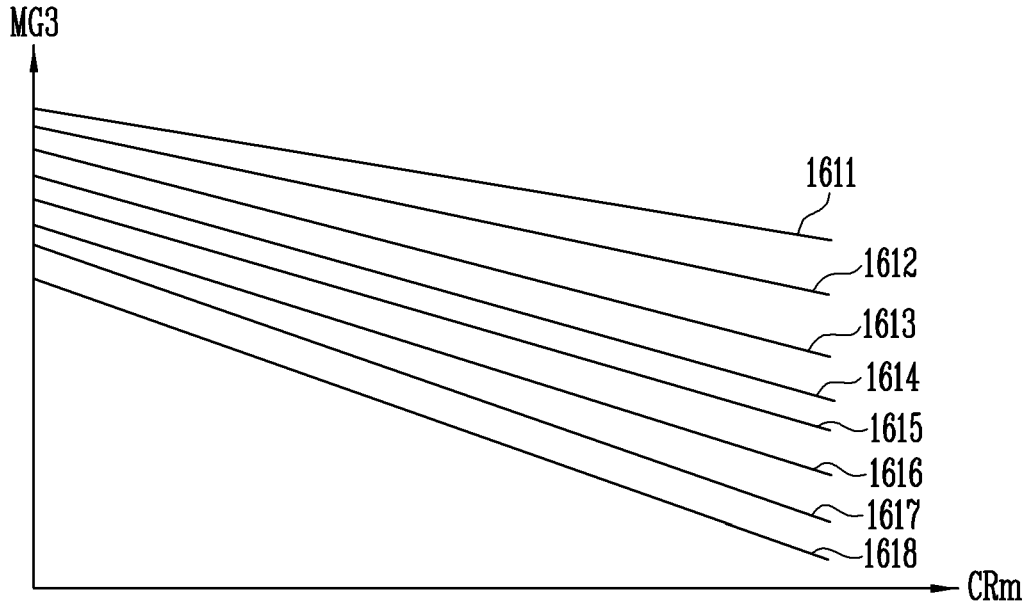
FIG. 25 is a diagram illustrating section lookup tables in accordance with an embodiment of the present disclosure.

FIG. 23 is a diagram illustrating a first power voltage controller in accordance with still another embodiment of the present disclosure. FIG. 24 is a diagram illustrating a maximum section detector in accordance with an embodiment of the present disclosure. FIG. 25 is a diagram illustrating section lookup tables in accordance with an embodiment of the present disclosure.

Referring to FIG. 23, the first power voltage controller 15*c* in accordance with the still another embodiment of the present disclosure may include a block load value provider 151, a reference block row selector 152, a first memory 153, a first switch unit 154, a reference block column selector 155, a second memory 156, a second switch unit 157, an adder 158', a grayscale value counter 159, a maximum section detector 160, a third memory 161, and a third switch unit 162. Overlapping descriptions of the block load value provider 151, the reference block row selector 152, the first memory 153, the first switch unit 154, the reference block column selector 155, the second memory 156, and the second switch unit 157 will be omitted.

The first power voltage controller 15*c* may calculate grayscale value ratios CRs of sections SC1, SC2, SC3, SC4, SC5, SC6, SC7, and SC8 according to magnitudes of grayscale values GVs. The first power voltage controller 15*c* may determine a third margin value VG3 according to a maximum section SCm among sections having grayscale value ratios greater than a reference ratio Rref. The first power voltage controller 15*c* may determine the third margin value MG3 to become smaller as the maximum section SCm becomes larger.

The sections SC1 to SC8 may be predetermined according to the magnitudes of the grayscale values GVs. For convenience of description, there is assumed a case where each of the grayscale values is expressed with 8 bits, to correspond to one of 256 grayscales. Grayscale 0 may be a black grayscale (minimum grayscale), and grayscale 255 may be a white grayscale (maximum grayscale. In another embodiment, each of the grayscale values GVs may be expressed with various bits such as 10 bits and 12 bits.

For example, the section SC1 may correspond to grayscales 0 to 31, the section SC2 may correspond to grayscales 32 to 63, the section SC3 may correspond to grayscales 64 to 95, the section SC4 may correspond to grayscales 96 to 127, the section SC5 may correspond to grayscales 128 to 159, the section SC6 may correspond to grayscales 160 to 191, the section SC7 may correspond to grayscales 192 to 223, and the section SC8 may correspond to grayscales 224 to 255. In this embodiment, the sections SC1 to SC8 are divided at an equal interval. However, in another embodiment, the sections SC1 to SC8 are divided at different intervals.

The grayscale value counter 159 may calculate grayscale value ratios CRs of grayscale values GVSs corresponding to each of the sections SC1 to SC8. For example, when a total number of grayscale values GVs is 3840*2160 and a number of grayscale values GVs corresponding to the section SC1 is 2160, the grayscale value ratio of the section SC1 may be from about 100% to about 3840%.

The maximum section detector 160 may receive grayscale value ratios CRs, and detect a maximum section SCm among the sections SC3, SC4, SC5, and SC6, which have grayscale value ratios greater than the reference ratio Rref. For example, referring to FIG. 24, the maximum section detector 160 may determine the section SC6 as the maximum section SCm.

In accordance with this embodiment, it is likely that grayscale values included in the sections SC7 and SC8 will not be displayed with a desired luminance. However, when the reference ratio Rref is properly set, a number of pixels having grayscale value ratios lower than the reference ratio Rref is very small, and therefore, it is highly likely that a display failure will not be viewed by a user. Thus, in accordance with this embodiment, power consumption can be reduced while minimizing the display failure.

The maximum section detector 160 may provide a maximum section SCm and a grayscale value ratio CRm of the maximum section SCm.

The third memory 162 may include a plurality of section lookup tables 1611, 1612, 1613, 1614, 1615, 1616, 1617, and 1618. The third switch unit 162 may include a plurality of switches SW5, SW6, . . . . The third switch unit 162 may select any one of the plurality of section lookup tables 1611 to 1618 according to the received maximum section SCm. For example, the third switch unit 162 may select a section lookup table 1618 which provides an averagely smaller third margin MG3 as the maximum section SCm becomes larger. For example, the third switch unit 162 may select a section lookup table 1611 which provides an averagely larger third margin MG3 as the maximum section SCm becomes smaller.

Each of the section lookup tables 1611 to 1618 may be predetermined to provide a smaller third margin value MG3 as the grayscale value ratio CRm of the maximum section SCm becomes larger.

The adder 158' may output a final margin value MGS' by adding up the first margin value MG1, the second margin value MG2, and the third margin value MG3. For example, the adder 158' may apply the same weight to the first margin value MG1, the second margin value MG2, and the third margin value MG3, or apply different weights to the first margin value MG1, the second margin value MG2, and the third margin value MG3. In other cases, the weight may be 0. That is, the first power voltage controller 15*c* may determine a margin value MGS' by adding up at least two of the first margin value MG1, the second margin value MG2, and the third margin value MG3.

Figure 26:
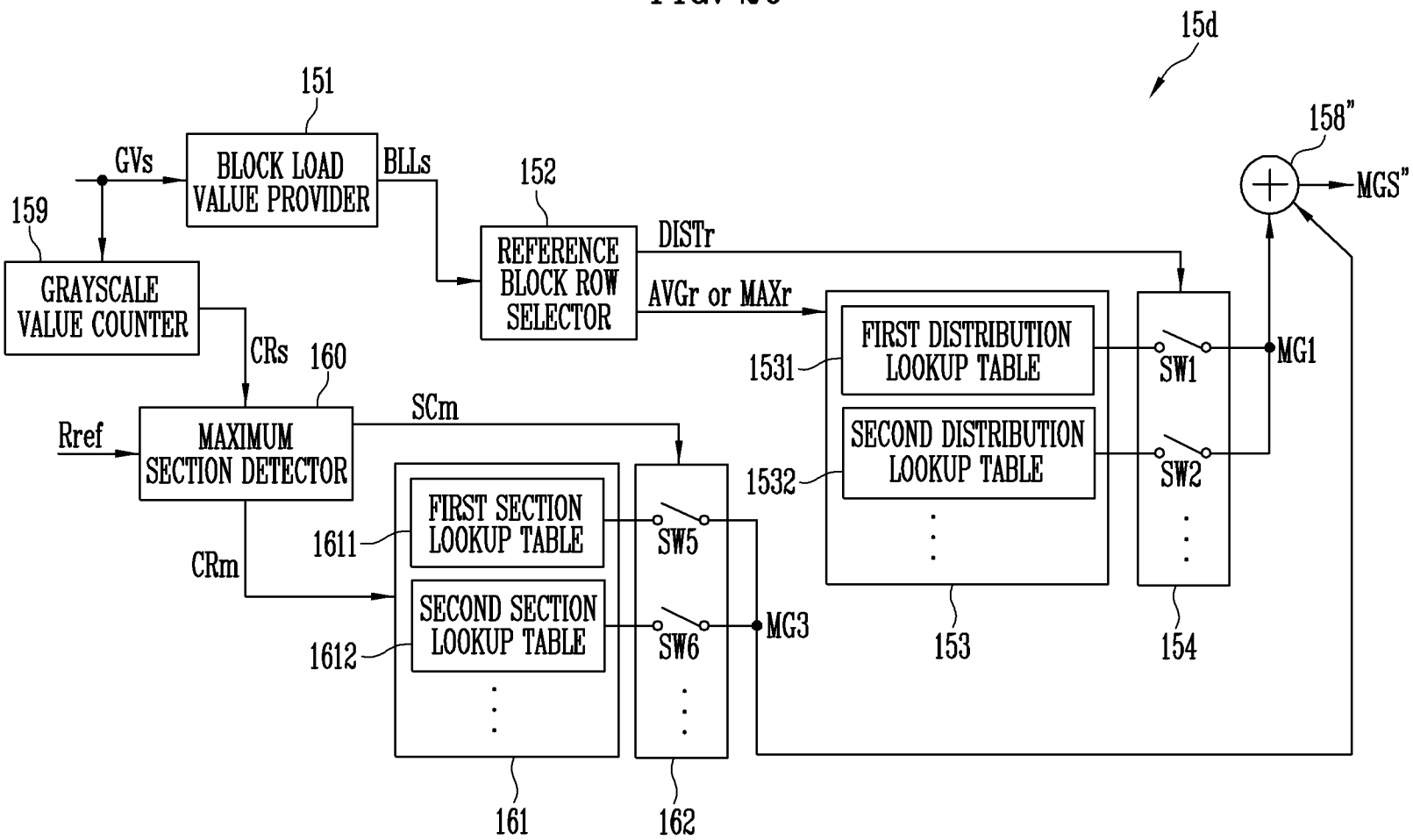
FIG. 26 is a diagram illustrating a first power voltage controller in accordance with still another embodiment of the present disclosure.

FIG. 26 is a diagram illustrating a first power voltage controller in accordance with still another embodiment of the present disclosure.

The first power voltage controller 15*d* shown in FIG. 26 is different from the first power voltage controller 15*c* shown in FIG. 23, in that the first power voltage controller 15*d* does not include the reference block column selector 155, the second memory 156, and the second switch unit 157. Accordingly, an adder 158" may output a final margin value MGS", based on the first margin value MG1 and the third margin value MG3.

When the data driver 12 includes the first data driver 12*a* and the second data driver 12*b* as shown in FIG. 4, issues shown in FIGS. 16 to 19 may not occur. Thus, the first power voltage controller 15*d* of this embodiment does not include the reference block column selector 155, the second memory 156, and the second switch unit 157, which have relatively small influence, so that the manufacturing cost of the display device can be reduced.

In the display device and the driving method thereof in accordance with the present disclosure, a minimum power voltage is supplied by analyzing a pattern of an image frame, so that power consumption can be reduced.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a plurality of blocks, each block including two or more pixels, all of the blocks being commonly coupled to a single first power line; and a first power voltage controller configured to determine a margin value of a first power voltage supplied to the single first power line based on load values of the blocks, wherein the first power voltage controller determines the load values based on grayscale values of the pixels included in each of the blocks, wherein a magnitude of the first power voltage is determined to become smaller as the margin value becomes larger, wherein the margin value includes a first margin value, wherein the first power voltage controller determines the first margin value according to a degree of distribution of load values of first blocks commonly coupled to the single first power line receiving the first power voltage in common and arranged in a first direction, wherein the first power voltage controller includes a reference block row selector which selects a reference block row of the first blocks based on the load values of all of the blocks, wherein the reference block row selector provides the degree of distribution of load values of first blocks, wherein the first power voltage controller further includes a plurality of distribution lookup tables, wherein the first power voltage controller selects one of the distribution lookup tables according to the degree of distribution of load values of first blocks, and wherein the first power voltage controller extracts the first margin value from a selected distribution lookup table based on an average value or maximum value of the load values of the first blocks.

2. The display device of claim 1, further comprising a plurality of first power sources, each of the first power sources is coupled to at least one of first power sub-lines, wherein the first power sub-lines are commonly coupled to the single first power line, and wherein the first power sub-lines are arranged in the first direction.

3. The display device of claim 2, wherein the first power voltage controller determines the first margin value to become larger as the load values of the first blocks are distributed more widely in the first direction.

4. The display device of claim 3, wherein the selected distribution lookup table provides the first margin value to become smaller as the average value or maximum value of the load values of the first blocks becomes larger.

5. The display device of claim 4, wherein the margin value further includes a second margin value, wherein the blocks include second blocks arranged in a second direction perpendicular to the first direction, and wherein the first power voltage controller determines the second margin value according to a position of one of the second blocks having a maximum value among load values of the second blocks.

6. The display device of claim 5, wherein the first power voltage controller determines the second margin value to become larger as the position of the second block having the maximum value becomes closer to the first power sub-lines.

7. The display device of claim 6, wherein the first power voltage controller includes a plurality of position lookup tables, wherein the first power voltage controller selects one of the position lookup tables according to the position of the second block having the maximum value, and wherein the first power voltage controller extracts the second margin value from a selected position lookup table, based on an average value or maximum value of the load values of the second blocks.

8. The display device of claim 7, wherein the selected position lookup table provides the second margin value to become smaller as the average value or maximum value of the load values of the second blocks becomes larger.

9. The display device of claim 8, wherein the margin value further includes a third margin value, wherein the first power voltage controller calculates grayscale value ratios of sections divided according to magnitudes of the grayscale values, and wherein the first power voltage controller determines the third margin value according to a maximum section among sections having grayscale value ratios greater than a reference ratio.

10. The display device of claim 9, wherein the first power voltage controller determines the third margin value to become smaller as the maximum section becomes larger.

11. The display device of claim 10, wherein the first power voltage controller includes a plurality of section lookup tables, wherein the first power voltage controller selects a section lookup table corresponding to the maximum section among the section lookup tables, and wherein the first power voltage controller extracts the third margin value from a selected section lookup table based on the grayscale value ratio of the maximum section.

12. The display device of claim 11, wherein the selected section lookup table provides the third margin value to become smaller as the grayscale value ratio of the maximum section becomes larger.

13. The display device of claim 12, wherein the first power voltage controller determines the margin value by adding up at least two of the first margin value, the second margin value, and the third margin value.

14. The display device of claim 2, wherein the first power voltage controller determines the first margin value to become larger as the variation or standard deviation of the load values of the first blocks becomes smaller.

15. The display device of claim 1, wherein the first power voltage controller determines the load values by adding up the grayscale values of the pixels included in each of the blocks.

* * * * *